United States Patent [19]

Rapp et al.

[11] 4,269,368

[45] May 26, 1981

[54] MICROPROCESSOR CONTROLLED PRODUCT ROVING SYSTEM

[75] Inventors: Kenneth L. Rapp, Granville; Walter Zolnerovich, Jr., Newark, both of Ohio

[73] Assignee: Owens-Corning Fiberglas Corporation, Toledo, Ohio

[21] Appl. No.: 958,582

[22] Filed: Nov. 7, 1978

[51] Int. Cl.[3] ..... B65H 54/02

[52] U.S. Cl. ..... 242/42; 242/36; 242/45; 364/470

[58] Field of Search ..... 242/42, 18 G, 45, 131, 242/131.1, 18 R, 36, 37; 364/470, 107; 28/190, 193

[56] References Cited

U.S. PATENT DOCUMENTS

| | | | |
|---|---|---|---|
| 3,792,821 | 2/1974 | Fallon | 242/42 |
| 3,860,187 | 1/1975 | Liska et al. | 242/45 |
| 3,966,132 | 6/1976 | Gelin et al. | 242/42 X |
| 4,074,871 | 2/1978 | Stotler | 242/42 |
| 4,143,506 | 3/1979 | Pierce et al. | 242/42 X |

*Primary Examiner*—Stanley N. Gilreath

*Attorney, Agent, or Firm*—Ronald C. Hudgens; Patrick P. Pacella; Paul T. Kashimba

[57] ABSTRACT

A microprocessor-based system for controlling a product roving process employing a pair of substantially identical high speed creel assemblies each of which being adapted to operatively carry a plurality of strand-serving packages having individual fiberous strands of material wound thereon. The individual strands are served out and gathered into groups to be collected as a roving on a collet which is turned by a winding motor. The microprocessor system controls the speed and acceleration of the winding motor and the number of strands which are being wound to form a desired product package. The system provides for a plurality of standby strands which are available to be automatically inserted into the system when a break or "end out" condition occurs in any of the operating strands being wound.

38 Claims, 19 Drawing Figures

10
12
14
16
16'
18
20
22
24
26
28
28'
30
30'
32
32'
33
33'
34
35
36
36'
38
40
42
42'
44
46
46'
48
50
50'
52
54
56
58
58'
60
62
64
65

TO FIG.5
FROM FIG.7
TACH
Z CROSS
BOUNCE ELIM.
BOUNCE ELIM.
BOUNCE ELIM.
COUNTER
CNT D
LOAD
CNT U
BR
PIA
PIA
FROM BUS 72.
TO BUS 72.
+5V
D
CLK
S
R
Q
Q̄

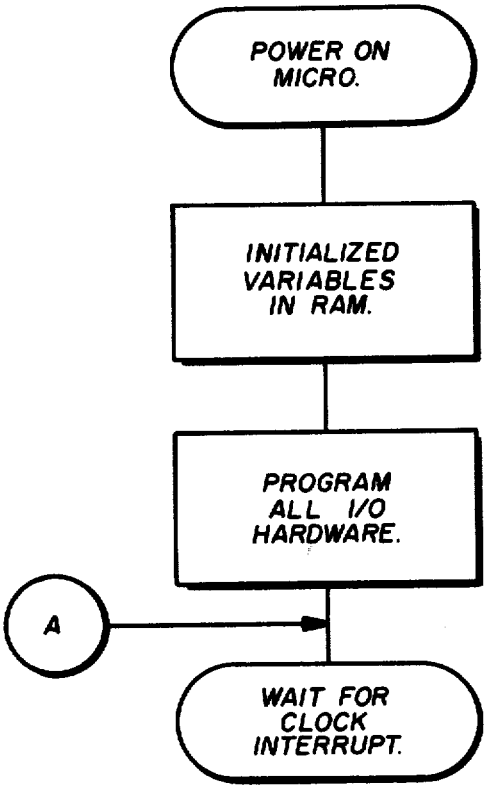
FIG. 12.1
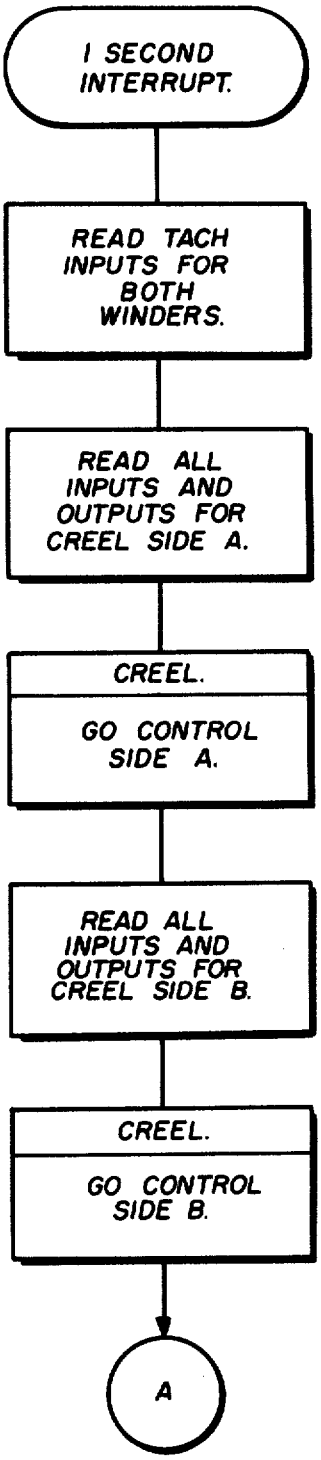
FIG. 12.2

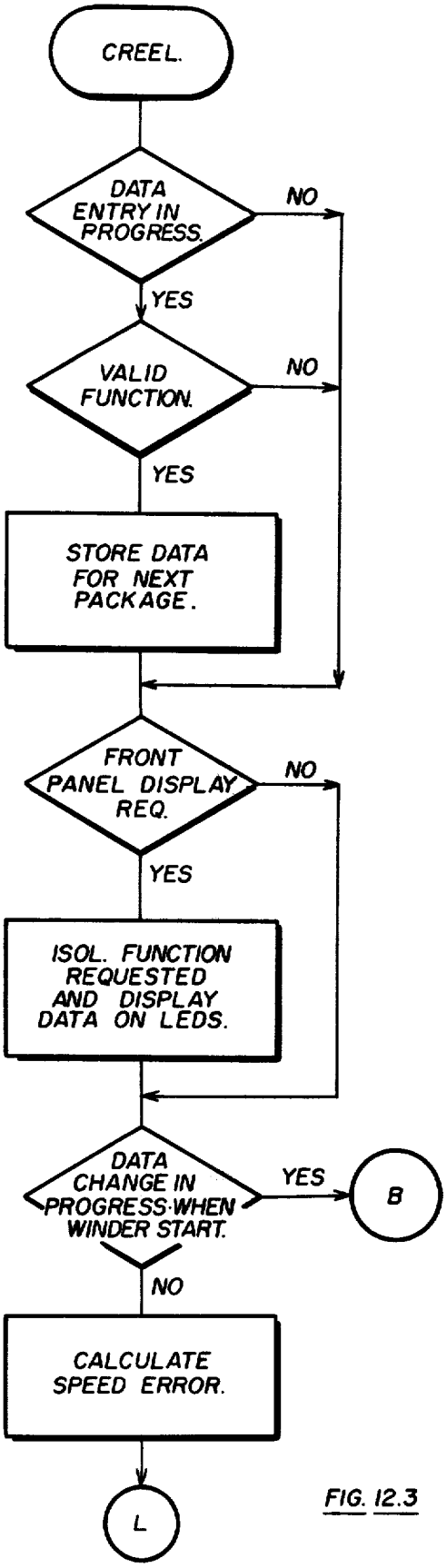
FIG. 12.3
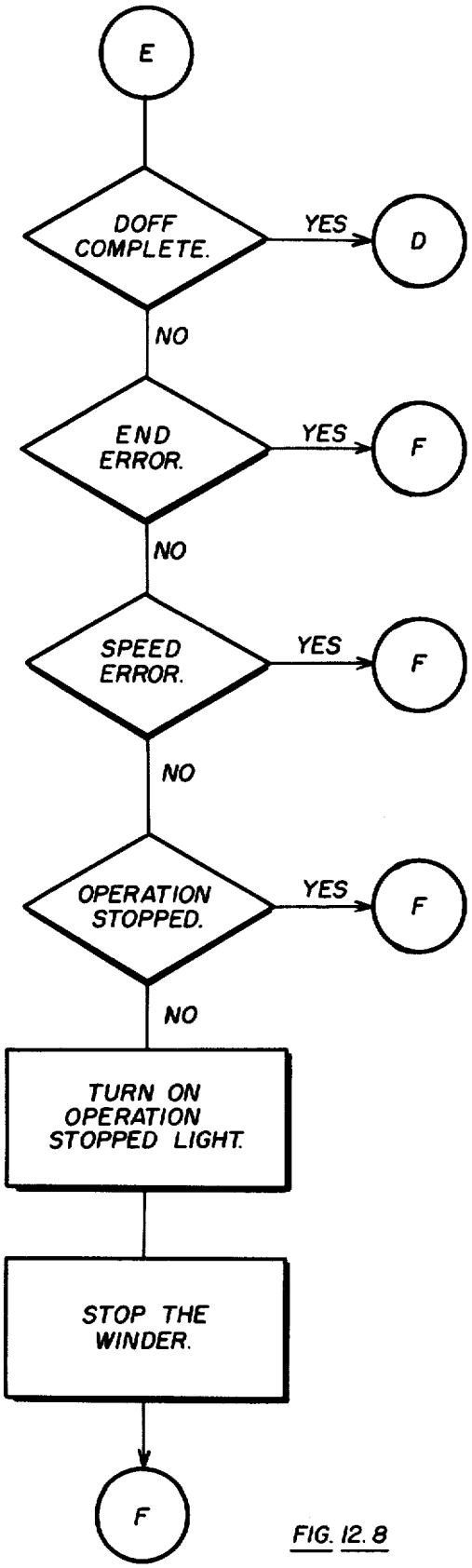
FIG. 12.8

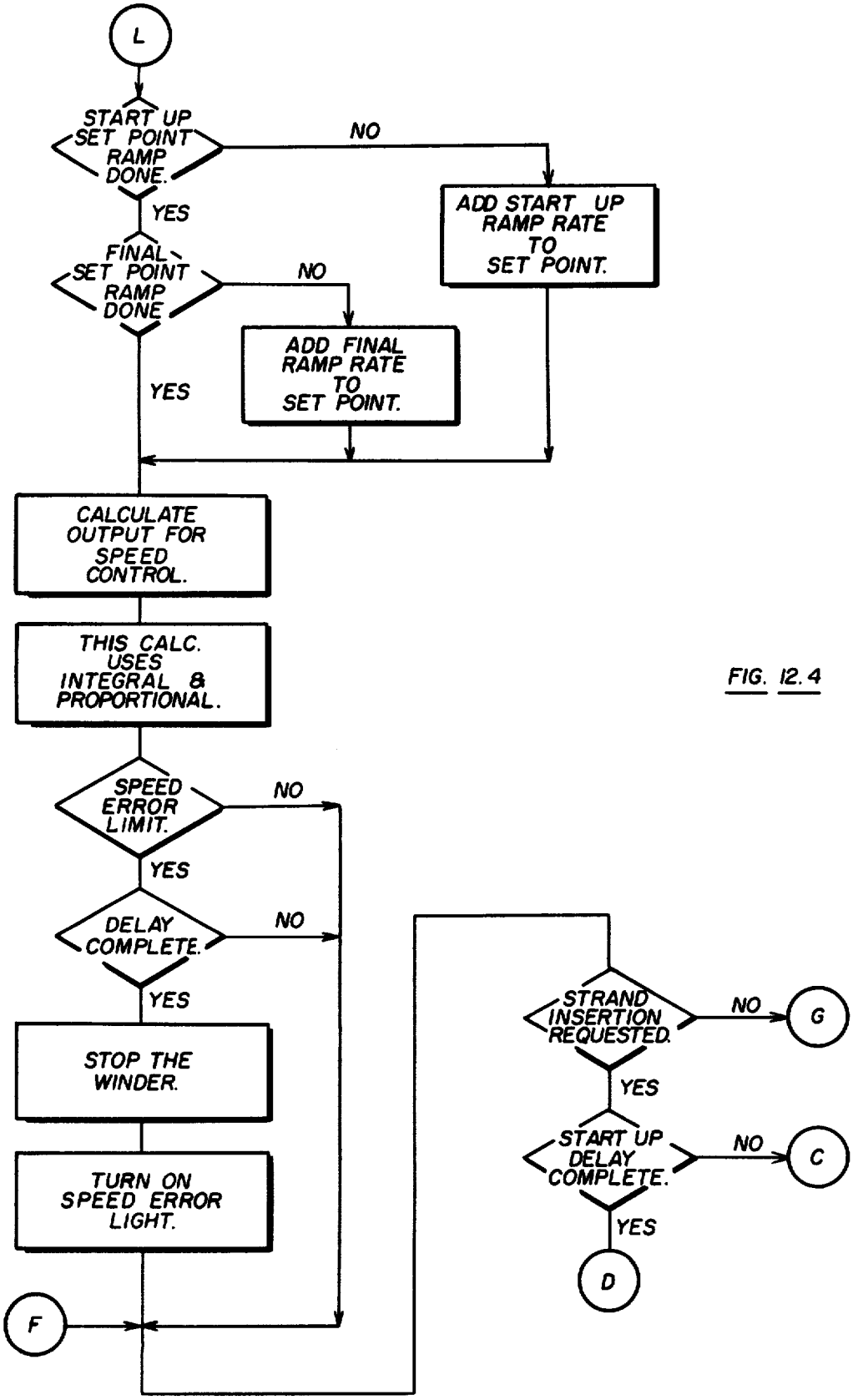
FIG. 12.4

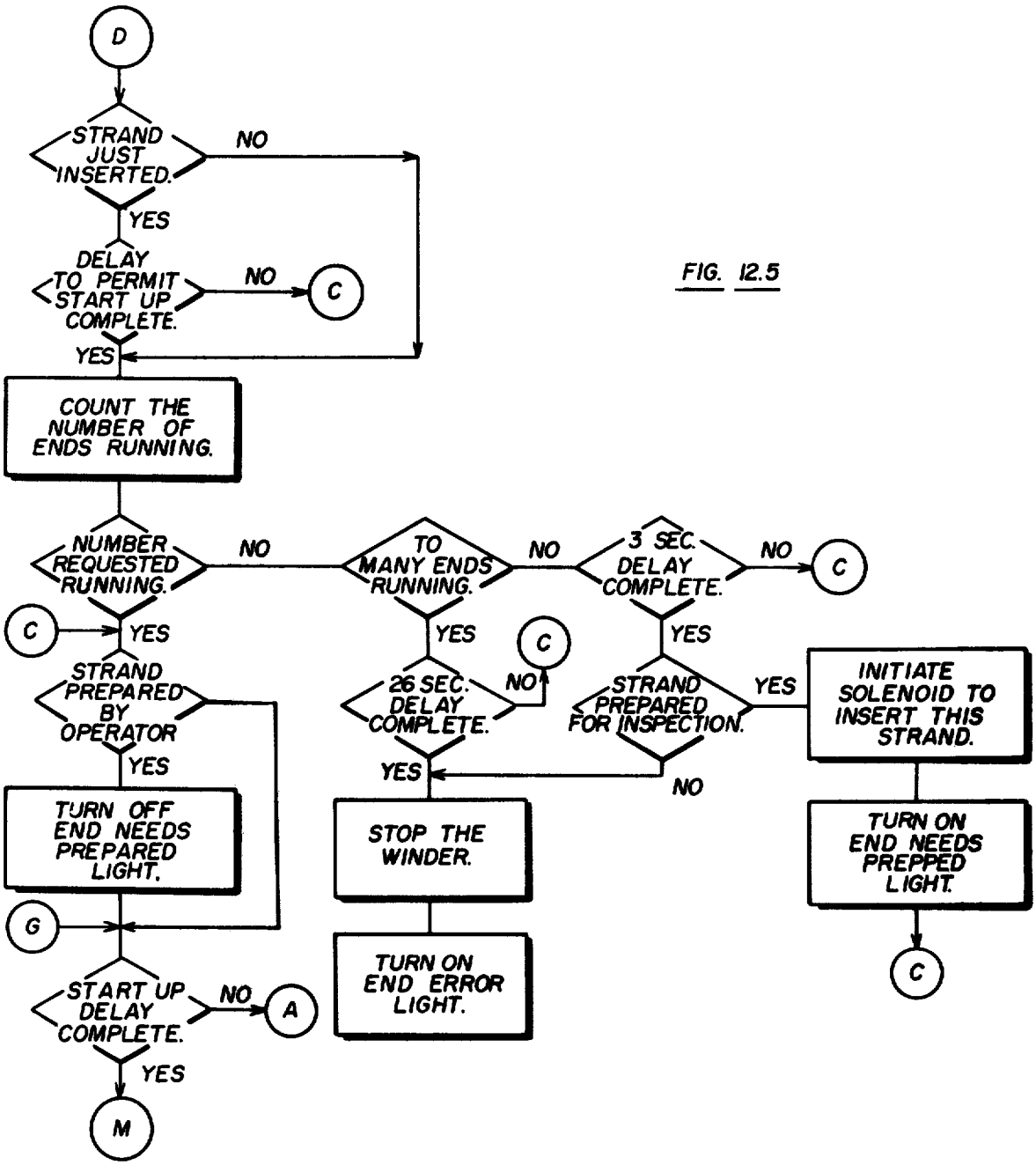
FIG. 12.5

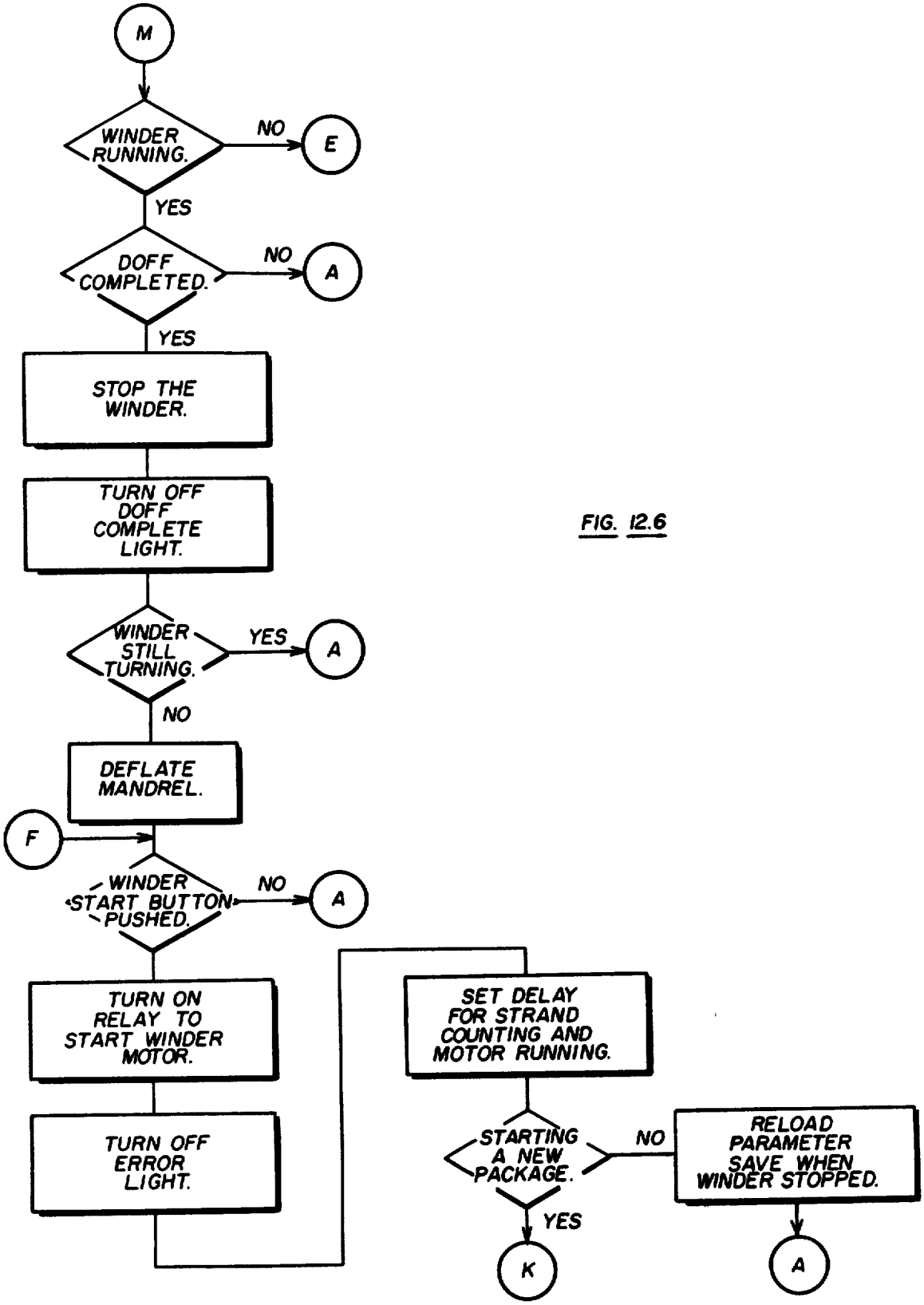
FIG. 12.6

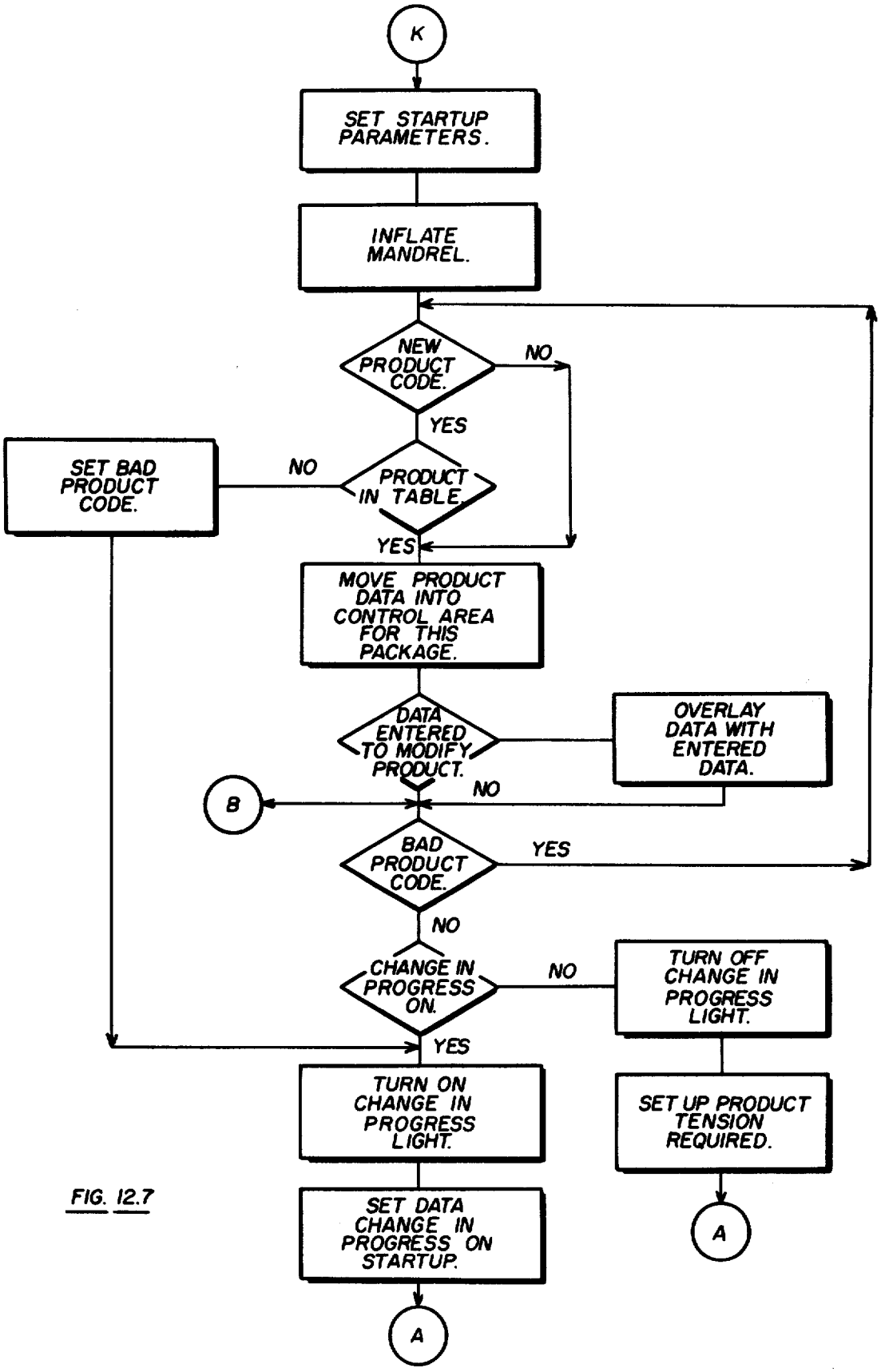
FIG. 12.7

MICROPROCESSOR CONTROLLED PRODUCT ROVING SYSTEM

BACKGROUND OF THE INVENTION

1. Field of the Invention

The invention relates generally to a product-forming roving process for use with fiberous materials, and more particularly to a microprocessor-controlled product roving system for automatically controlling the winder speed and acceleration and automatic strand insertion in a product forming roving process.

2. Statement of the Prior Art

Today's product roving systems must provide a low-cost efficient method of rapidly producing relatively high quality product packages which are uniform throughout and which do not give away excess product material and yet always include the proper number of strands to meet the high quality control standards of today's customers. Modern product roving systems must be flexible and able to quickly and efficiently switch to forming product packages of different grades and diameters of fibers and having different nunbers of strands and package sizes or weights which are required by customers. Therefore, today's product roving systems must provide means for monitoring the number, length and speed of the operating strands which are being would together to form the product while controlling winding speed and acceleration to avoid breakage yet assure that the packages are produced in the shortest possible period of time without sacrificing quality. Producing such a product roving system capable of meeting all of today's requirements poses many difficult and diverse problems.

Due to the fragile nature of the individual strands and the number of strands involved in a typical product-forming process, it is imperative that strand replacement be accomplished manually while allowing for some mechanization to keep the process going while the broken strand or strands are being replaced. In a system utilizing twenty or more strands, it is very inefficient to stop the entire roving process in order to replace a single broken strand, yet is absolutely imperative that the broken strands be replaced in order that the desired number of strands required to form the particular product package selected are wound during the roving process. Therefore, a strand insertion system which can automatically insert standby strands when a break or "end out" condition is detected is necessary as is a means for monitoring the number of operating strands actually being gathered together and wound for winder speed control purposes.

Furthermore, various product packages require the different numbers, grades and/or diameters of individual strands be wound and hence breaks in such strands which required the substitution of standby strands necessarily produce serving packages having diverse lengths of strands remaining thereon. Thus, there is a need for monitoring the length of each strand remaining on the various serving packages and/or for monitoring the presence or absence of the operating strands actually being wound for counting same to provide a strand insertion system for automatically inserting standby strands previously prepared by an operator to allow the roving process to continue regardless of strand run-out due to the divergent lengths of strand remaining on the various serving packages or to actual breaks in one or more of the operating strands themselves.

Another problem area in high speed roving systems relates to the speed and acceleration with which the winder or collet collects the strands. As the product forms, the linear feed-out speed from each individual serving package increases if the winder turns the collet at a constant speed. The effect of this procedure is to produce a high speed pull-out or take-out from each serving package which can produce sufficient strain to cause the individual strands to break. Another area of concern occurs at the initial start-up of the system since too rapid a start may produce a sharp pull on some of the strands causing breakage or equipment damage at the onset of the operation. Coupled with this is the fact that the efficiency and therefore the profitability of the roving process depends on the speed with which it can produce each individual process, but again, this must be weighed against the fact that modern customers for the various product packages require a high quality uniform package.

The prior art teaches several possible approaches to combat the start-up problems detailed above, none of which is truly efficient or cost effective. One prior art approach controls the winder speed at start-up to such an extent that the tension on the strands is individually built up over a long period of time so as not to produce any sudden acceleration or tension at all. This results in the slow and inefficient production of the product package and is commercially unacceptable. Another prior art solution involves the detection of the number of strands running as compared to the number of strands desired to be wound to form a particular product package and includes means for substituting standby strands into the system while continuing to wind the collet in order to avoid not only the time delay involved in stopping the system and restringing strands but also to avoid the associated tension problems associated with each individual start-up. The greater the number of times the system has to be restarted, the greater will be the chances that one or more of the strands will break during start-up. This system however, is not fully effective since it is directed to solving a particular problem and does not provide all of the status indication of the present system together with automatic insertion, multiple standby strands, and an automatic shut-down, when required.

Still another problem area involves the tensioning of the strands and the breakage which can be produced when the tension becomes too great. When the product package being formed becomes larger in size or diameter, the motor speed must be controlled so that as the product package becomes larger, the winding speed decreases proportionately so that there is a constant or near constant linear take-out speed of the individual strands from the serving packages. Likewise, the tension on each individual strand is determined by the total number of strands actually running or being wound to form the product and each product selected to be formed may require a different number of operating strands to be wound. Therefore, an accurate count of the number of operating strands running is useful not only for the purposes of inserting standby strands automatically when the counted number of operating strands is different from the desired number of strands required for forming the product package, but is also useful in determining the amount of tension on the individual operating strands themselves.

Each of the problems of the prior art discussed above, taken alone, may allow for one or more solutions which provide varying degrees of acceptability, and in one form or another, many proposed solutions have been offered by the prior art. However, no attempt has been made to solve all of the above-discussed problems by providing control over the entire roving process. The need for a common control system which controls automatic strand insertion, tension, and winder speed and acceleration is essential for modern high quality, high efficiency roving processes.

It has been a practice of the prior art to produce a composite roving by withdrawing individual strands or rovings from serving packages held in creels and then converging the strands or rovings into a group and winding the group on a rotatable package tube or collet. It has been found that one of the major problems in producing such a composite linear product is (1) maintaining a positive end count on the number of operating strands actually being wound and (2) controlling the speed and acceleration at which the strands are fed out from their serving packages. The specifications for today's product packages vary significantly but there has been an ever-increasing requirement for greater accuracy in maintaining a predetermined exact number of rovings or strands wound to form a uniform, quality composite product. Thus, a need for increased reliability, durability and control to meet the more stringent requirements for producing today's composite quality rovings with an exact end count is real, and is yet, unfulfilled.

Apparatus has been used in the prior art that performs an end count function as an incidental control and effects a strand tensioning to provide a composite roving made up of individual rovings having a substantially uniform tension. In U.S. Pat. No. 3,361,375 which issued on Jan. 2, 1968, an end count was provided by a gravity-controlled drop member or a drop bar held in an elevated position by the tension on the roving threaded through in a guide in the drop member itself. When the roving broke or an end out condition occurred, the drop bar would physically fall to close a switch and stop the winding motor to shut down the process. While the above-described approach was satisfactory for its intended purpose, it could not be used with the high speed creel systems of today where higher efficiency and quality are required.

As a further solution to these problems, U.S. Pat. No. 4,010,908 which issued on Mar. 8, 1977 provided an apparatus for linearly advancing a continuous strand element and directing a beam of light on the element. Reflected light therefrom was monitored and a change in the intensity of the light reflected from the strand element was used as an indication of a corresponding change in the speed of advancement of the element. This indication was used to control the linear advancement of the element itself. In other words, an optical sensing means was used not only to detect the presence or absence of the strand, but was also used to sense strand movement within predetermined limits. Once the presence or absence of the various strands and the motion thereof was detected, a problem arose as to how to translate that information into useful control signals and a second problem arose as to how to deliver new strands when a break or "end out" condition was detected.

A method for disabling the strand delivery means after cessation of motion of a predetermined number of linear bodies was required and this solution was suggested in U.S. Pat. No. 3,792,861, which issued on Feb. 19, 1974 and taught a method of combining groups or bundles of filaments, strands or rovings into a composite group or roving in packaging the composite group by winding in a manner controlled by the positive sensing of each individual strand by monitoring the motion thereof.

Another area of the prior art involved is trying to produce a reliable packaging system wherein the winding motor speed could be controlled as a result of the detection of the motion or presence of individual strands. A motor speed control system using SCR power control circuits for accurately controlling the phase angle or firing point in order to accurately control the armature current to selectively increase or decrease the speed of the motor was developed to solve this problem. Silicon control rectifiers for use in various switching and control applications are known in the prior art and it is also known to use the phase angle or firing point in the positive or negative half-cycle of the AC wave from at which the SCR is switched to control the motor speed. When the SCR control circuits are digitally constructed, a dithering of the controlled motor provides a highly reliable, fast and accurate response to the generated speed control signals.

The prior art failed to find a commercially acceptable solution to all of these problems that are in a single system and the problem of determining the required motor speed of operation for a particular product package desired to be formed while monitoring and assembling the signals to control the insertion of new strands as well as to control the speed acceleration of the motor have not been totally successful. For this particular problem, one strand package must be replaced by an operator while allowing the roving process to continue uninterrupted. Furthermore, there must be a method of changing variables whenever a new product package is to be formed which may have a different composition of strands, both number and/or diameter; a different winding speed and/or acceleration; and a different end size for the product package, measured in terms of weight, diameter, strand yardage wound, or the like. While most of these problems have been addressed separately in the prior art, no single system exists for efficiently and reliably producing a variety of desired product packages with a smooth transition when switching from one type of package to the the next or when changing any of the above-discussed variables of requirements.

The present invention solves substantially all of these problems in a single system by using a microprocessor-based control system with new and unique methods of integrating the output of various sensors with data stored in the computer to effectively control the entire product roving operation, including strand insertion, tension, and the control of winder speed and acceleration while providing status information to the operator for management or control purposes, as desired.

SUMMARY OF THE INVENTION

One embodiment of the present invention teaches a method for controlling winder speed in a package roving process wherein a high speed creel containing a plurality of serving packages for dispensing strands which are gathered together in a group and wound on a collet to produce a product package and wherein the collet is turned by a winder motor includes the steps of (1) storing a plurality of desired motor speeds each corresponding to a different number of operating strands required to be wound for forming a selected product package; (2) selecting a particular desired motor speed based upon the number of strands actually running; (3) measuring the actual speed of the motor; (4) comparing the actual winder speed to the desired winder speed; (5) increasing and decreasing motor speed when the difference between the actual and desired speeds exceed a predetermined amount.

Another embodiment of the present invention teaches a method for controlling strand insertion including the steps of (1) counting the number of operating strands actually gathered into a group to be wound on a collet; (2) inserting one of the stored number of operator-prepared standby strands into said group being wound as long as the number of operator-prepared strands exceeds the counted number of strands by a value no greater than the value of the number of prepared standby strands; (3) stopping the roving process when the desired number of strands exceeds the counted number of strands and there are no standby strands prepared for insertion to restore desired system operation.

Of course, the invention also contemplates a method for controlling both strand insertion and motor speed by combining the above steps and also includes an embodiment teaching an apparatus for controlling the winding speed, a high speed creel used in a package roving process comprising (1) means for counting and storing the actual number of operating strands being wound; (2) means for selecting the stored motor speed function required for forming a particular product; (3) means for measuring the actual speed of the motor; (4) means for increasing and decreasing the motor speed when the difference between the measured speed and the stored motor speed function exceeds a first value and (5) means for stopping the motor when the difference exceeds a second predetermined value.

Similarly, the present invention contemplates an apparatus for controlling strand insertion in a high speed creel system used in a package roving process comprising (1) means for counting and storing the number of operating strands actually being wound; (2) means for monitoring the number of operator-prepared standby serving strands available for insertion into the group of operating strands; (3) means for inserting the required number of prepared standby strands into the group of operating strands actually being wound so that the number of operating strands actually being wound is equal to the number required for forming the predetermined selected product package so long as there are enough standby strands available and for stopping the winding motor and shutting down the roving process whenever there is a difference between the actual counted number of operating strands actually being wound and the desired number of strands required to be wound for forming the particular product package and insufficient standby strands are available for corrective insertion.

In the preferred embodiment of the present invention, the above-identified apparatus and the above-identified method for controlling either the winding motor speed and acceleration and/or the automatic creel insertion utilizes a microprocessor-based system including a memory means and program means stored within the memory means for execution by the micro-computer to implement program sequences for controlling the above-identified operations. Many other advantages and meritorious features of the present invention will be more fully understood from the following detailed description of the drawings and the preferred embodiment, the appended claims and the drawings, which are described briefly hereinbelow.

BRIEF DESCRIPTION OF THE DRAWINGS

FIG. 12.1 is a flow diagram for the pov·er-on initialization of the microprocessor-based system of the present invention;

FIG. 12.2 is a flow diagram illustrating the overall operation of the present invention for one complete cycle;

FIGS. 12.3 through 12.8 represent the CREEL subroutine of the present invention referred to in the flow diagram of FIG. 12.2 with the various entry and exit points labeled to enable an easy understanding of the overall process followed by the microprocessor in implementing the controls of the present invention.

DESCRIPTION OF THE PREFERRED EMBODIMENT

Figures 1, 2:
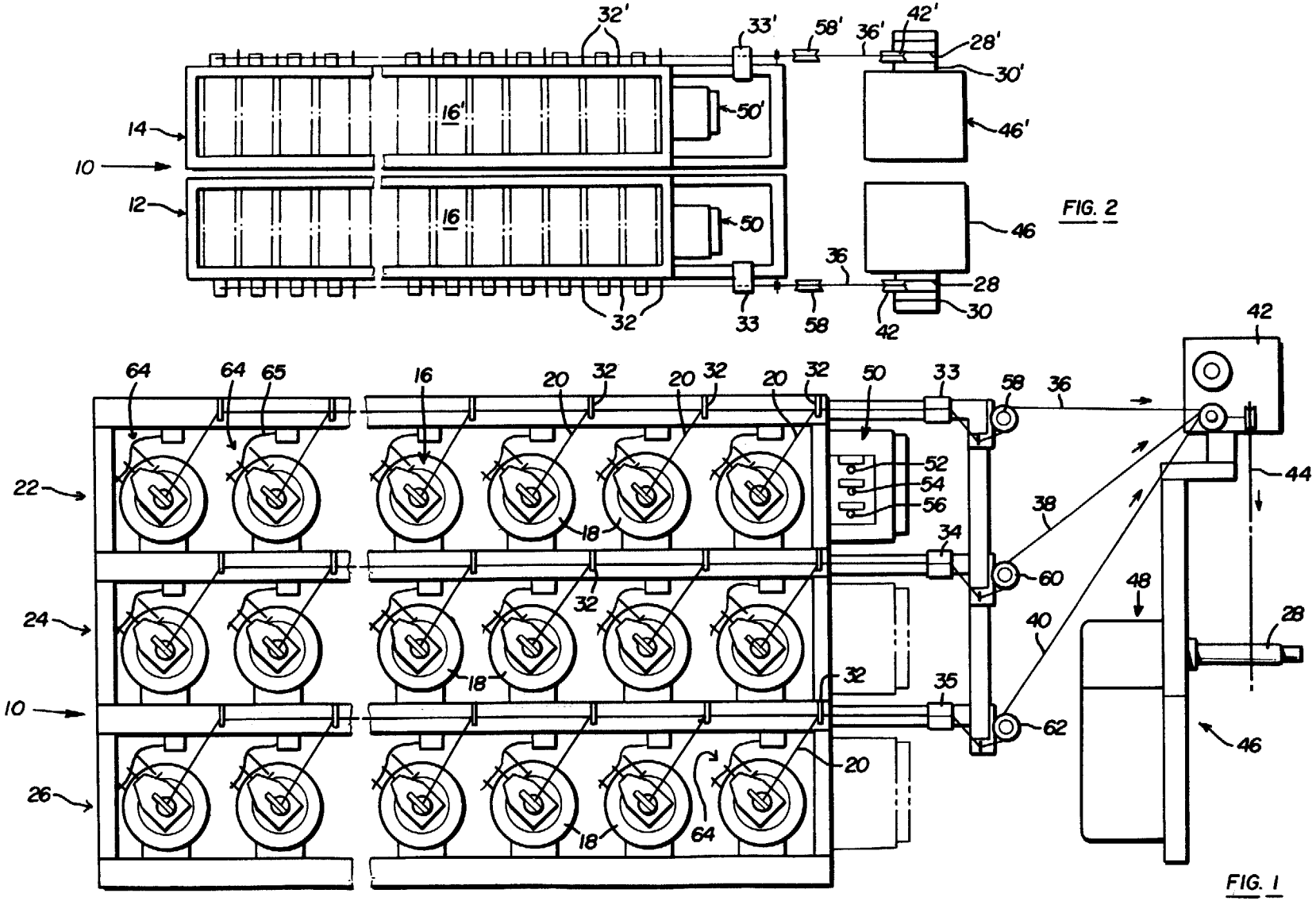
FIG. 1 is a side view illustrating a typical high speed creel and winder assembly utilizing the microprocessor-based control system of the present invention.
FIG. 2 is a top view, in reduced scale, of the high speed creel and winder assembly of FIG. 1 showing the two substantially identical sides thereof.

FIGS. 1 and 2 illustrate a high speed creel and winder assembly 10 usable in a conventional package roving process. In the preferred embodiment of the present invention, the high speed creel and winder assembly 10 comprises two separate but substantially identical sides labeled 12 and 14, respectively. Each of the sides 12, 14 includes a creel assembly 16 having a plurality of strand-serving packages 18 operatively disposed thereon. Each of the strand-serving packages 18 has wound thereon an individual strand of fibrous material 20 which is served, dispensed or delivered from the package 18 by unwinding to produce an end product, as hereinafter described. In the particular embodiment shown each side 12, 14 on the creel assembly 16 operatively houses a matrix formation comprising 3 rows of 8 each serving packages 18 where the individual strands 20 from each of the packages 18 are adapted to be gathered or collected together to form a group which is then further collected and wound on a collet 28 to form a desired product package 30.

Each strand-serving package 18 has associated with it a strand insertion guide assembly 32 into which the individual strand 20 is fed or threaded and then guided through to the end of a row 22, 24 or 26, as illustrated in FIGS. 1 and 2, where it is prepared for a corresponding strand insertion device 33, 34 and 35, respectively, which inserts the individual strands 20 into groups 36, 38 and 40 of operating strands 20 in response to an insertion command from the microprocessor-based control system of the present invention. The groups 36, 38 and 40 of operating strands 20 from each of the rows 22, 24 and 26 of strandserving packages 18 are fed into a strand tensioning assembly 42 which further combines or collects the three groups 36, 38, 40 of strands together and redirects the gathered groups as a roving 44 toward the collet 28 upon which the product package 30 is to be formed. The collet 28 is controllably rotated or turned by a winder motor assembly 46 having a winder motor 48 which controls the speed at which the collet 28 turns to wind the collected groups 36, 38, 40 of operation strands 20 (roving 44) to form a desired product package 30.

A wider panel 50 is shown as being attached to the first row 22 of strand-serving packages 20 of the creel assembly 16 and is used to monitor the status of the creel assembly 16. On the panel 50 are located three switches or push buttons called "end prep" buttons 52, 54 and 56 which are under manual operator control. When an individual strand 20 of any one of the strand-serving packages 18 is broken or runs out, the operator at the creel station must replace the bad serving package by inserting a new replacement package or by repairing the bad one and then preparing a stand-by strand 20 by threading the individual strand 20 from the replaced or repaired strand-serving package 18 through its associated strand insertion guide 32 and then carrying it over to the end of its row 22, 24, 26 to the corresponding strand insertion unit 33, 34, 35 where it is prepared by the operator in a ready or stand-by state and made available for automatic strand insertion, as hereinafter described. After the operator has set up another strand-serving package 18 and has prepared or "prepped" a stand-by strand 20 for automatic insertion by the control system of the present invention, the operator manually presses a push button 52, 54, 56 depending upon the number of out-of-service strands which were re-prepared and which are now ready or in "stand-by" status for automatic insertion purposes. The pushing of the appropriate push button 52, 54 or 56 indicates to the control system of the present invention that it may now automatically insert one or more of the prepared stand-by strands 20 into one or more of the groups 36, 38, 40 of operating strands 20 currently being collected and wound on the collect 28 as required to meet the needs of the system.

The strand insertion guides 32 associated with each of the individual strand-serving packages 18 and the strand insertion mechanisms 33, 34 and 35 located at the end of the rows 22, 24 and 26, respectively, are the subjects of a U.S. patent application of Richard Pierce and Arnold Eisenberg, Ser. No. 864,069, filed Dec. 23, 1977, now U.S. Pat. No. 4,143,506, which was issued Mar. 13, 1979, and which is assigned to the Assignee of the present invention and which is specifically incorporated by reference herein.

Each of the individual strand-serving packages 18 supplies, delivers or dispenses an individual strand 20 of fiber-like material, for example, a bundle of continuous glass filaments or the like. In FIGS. 1 and 2, the creel assembly of each of the sides 12, 14 of the high speed creel and winding apparatus 10 of the present invention includes three rows 22, 24 and 26, and each of these rows is shown as including eight individual strand-serving packages 18. Each of the strand-serving packages 18 supplies or dispenses one individual strand 20 so that for each of the rows 22, 24 and 26 eight individual strands 20 are unwound and advanced from their respective strand-serving packages 18; collected or gathered together to form groups 36, 38 and 40 of eight strands each; and these groups then engage guide pulleys 58, 60 and 62 before being passed through another means for gathering or collecting all of the groups 36, 38 and 40 of operating strands 20 in a strand tensioner assembly 42 which produces a combined roving 44 used to form the product package 30 as it is advanced and wound on the collet 28 by the turning or rotating action of the winder 46. The winder motor assembly 46 includes a winding motor 48 and a collet 28 which is rotated to pull the collected individual strands 20 from their associated strand-serving packages 18 so as to collect the combined roving and form a wound product package 30 upon the rotatably journaled collet 28 which is rotatably driven by the winding motor 48, as known in the art.

When the product package or "doff" 30 is complete, the control system of the present invention turns off the creel system 16 and new data may be entered into the control system based upon the type of product (i.e., the number of strands required to be wound to form the product package, the length of the roving and/or the weight of the package, the type and diameter of the strand or filament to be used, and the like) desired to be formed with the next roving operation. Using the microprocessor-based control system discussed hereinbelow, the number of strand-serving packages 18 actually running or dispensing individual operating strands 20 to be gathered into a group and wound, or more accurately, the presence or absence of each of the individual operating strands 20 actually being dispensed or supplied for such running strand-serving packages 18 is sensed, detected or monitored, as by a conventional fiber optic monitoring system 64, such as that shown in U.S. Pat. No. 4,010,908, which issued on Mar. 8, 1977 to the Assignee of the present invention and which is incorporated by reference herein. An individual strand monitor 64 is operatively disposed with respect to each strand-serving package 18 to supply information to the microprocessor-based control system as to the presence or absence of the individual strand 20 currently being dispensed or supplied from a corresponding strand-serving package 18 to enable the system of the present invention to form the desired or pre-programmed product package or package roving 30 requested, and also to monitor the individual strand-serving packages 18 for run-outs or breaks in the individual strands 20.

Power is supplied to the system via a conventional 440 volt, 60 Hz line and a conventional 110 volt, 60 Hz line for driving or running the motor 48 of the winder 46 as well as for operating various other devices to be hereinafter described whose functions relate to the operation of the creel and winder assembly 10 of the present invention.

Figure 3:
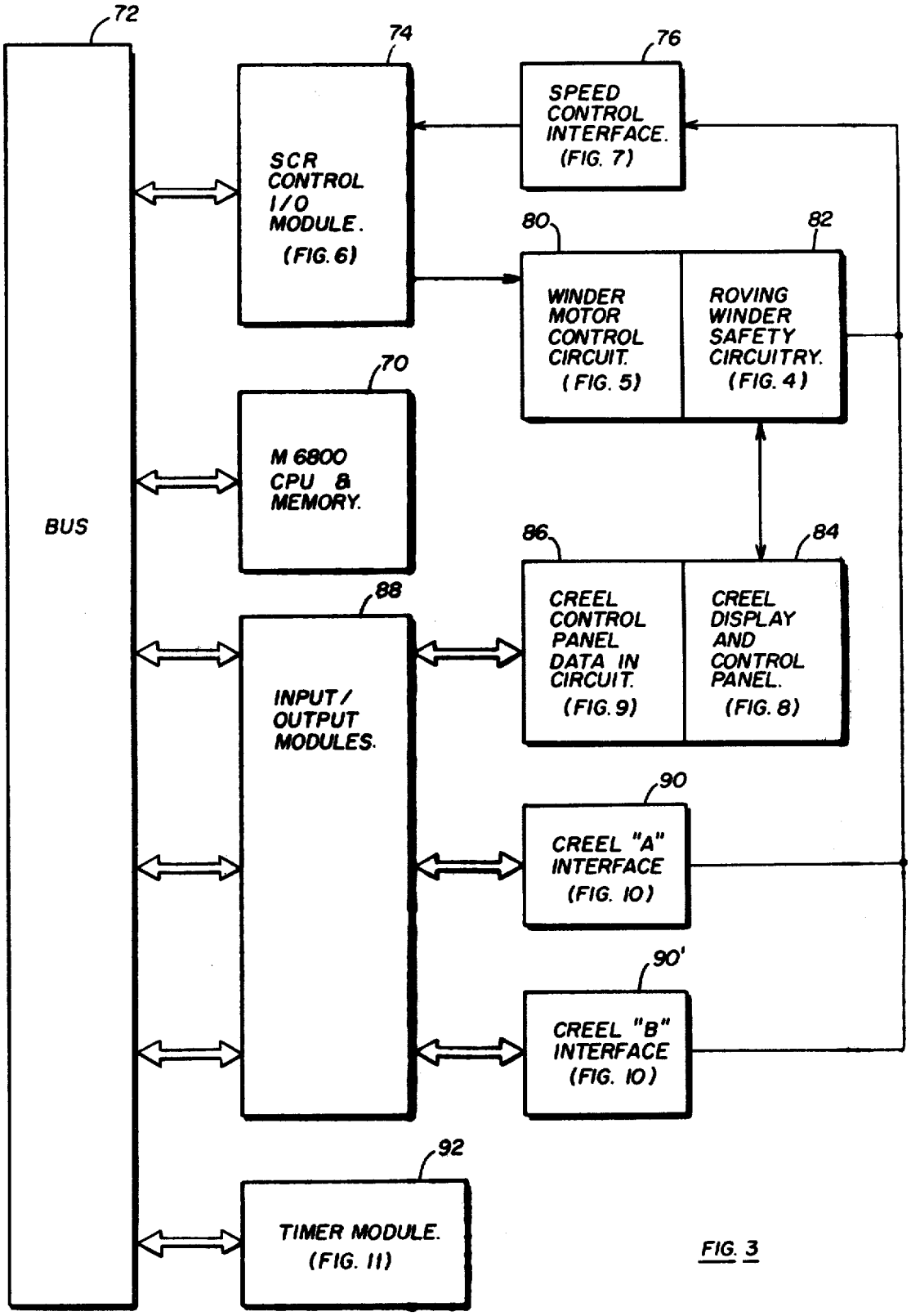
FIG. 3 is a block diagram of the microprocessor-based control system of the present invention.

FIG. 3 shows, in block diagram form, the microprocessor-based control system of the present invention. In the preferred embodiment, the system is controlled by a conventional microprocessor system, such as a Motorola M6800 processor or CPU with associated memory which forms a complete computer on a single circuit board which will provide a microprocessor CPU together with RAM and/or ROM memory, and the conventionally associated clock restart, bus interface, and control circuitry. The block 70 represents a conventional microcomputer as described hereinabove with a standard bus interface being represented by block 72 for the purposes of illustrating the interface of external devices with the computer 70.

The block labeled 74 represents an SCR control interface input/output (I/0) module which is used to communicate with the motor winding system 46 and to receive signals therefrom for controlling speed of the winder via the M6800 microprocessor 70 and the data bus 72. The SCR control input/output module 74 contains conventional Peripheral Interface Adapter (PIAs) which permit the M6800 microprocessor 70 to read and/or write into its internal registers as another memory unit and address them through the PIAs as such. The operation and structure of a Peripheral Interface Adapter or PIA is described in the Motorola publication entitled "Microprocessor Applications Manual" printed in 1975 and which is incorporated by reference herein.

A tachometer or motor speed measurement input is supplied through a creel interface circuit, represented by block 76, to the SCR control I/O modules of block 74 and these inputs are used to supply a motor or winding speed-indicative signal to the M6800 microprocessor 70. The other interface input coupled to the SCR control I/O module of block 74 is an isolation interface circuit which provides a zero-crossing signal, i.e., a signal which indicates the point in time when the power supplied via the AC source crosses through the zero voltage level both on the positive and the negative transitions. When the zero-crossing detector signal and the tachometer signals are fed to the SCR control input-/output modules of block 74, the computer 70 is enabled to calculate in accordance with stored programs and utilizing the stored information in its memory, the exact firing point in the AC wave form necessary to deliver sufficient driven current to the motor 48 in order to attain and/or maintain a desired motor or winding speed. These firing signals are fed to block 80 which represents the winder motor control circuitry of the present invention.

The winder motor control circuitry of block 80 uses isolation interface circuits to provide firing signals in both the positive and negative cycles of the AC wave form to a corresponding SCR (silicon-controlled rectifier) for providing driving current to the armature of the winder motor 48 to control motor speed, as known in the art. The winder motor control circuit of block 80 also contains circuitry for supervising and maintaining the power to the field windings of the motor.

Block 82 represents a roving winder in the general safety circuitry which is used therein to illustrate the distribution of the 440 volt AC power supplied to the roving system of the present invention. As will be discussed later, the roving system safety circuitry of block 82 also represents or illustrates the operation of the entire roving process and shows switches and other safety devices built into the entire system at various locations and detailed later in the specification but described with respect to block 80 for the sake of convenience.

The remainder of the circuits represented by the blocks of FIG. 3 are dedicated to the creel system 16 and its interface with the data bus 72 of the M6800 microprocessor 70 as well as the creel station display panel and the timing circuitry. The creel station display control panel, represented generally by block 84, is a status monitoring system which contains data and function entry means for programming or entering into the computer 70 the particular type of product selected to be made in particular roving process operation. This pre-programmed data includes the speeds at which the product package 30 is to be formed, usually entered as a function of the product actually being wound on the collet 28; the number of desired strands and therefore the number of strand-serving packages required to be used for making a particular product package, as well as the desired speed and acceleration control functions to be used for forming a particular product package 30, etc. Block 86 represents creel control panel data entry circuitry which is used to interface the output of the data and function entry switches to the input/output circuit boards of block 88. Block 88 includes a plurality of any conventionally available, off-the-shelf, input-/output modules, for example, the 32 input/output M6800 MM03 circuit boards commercially available for Motorola and described in the above-mentioned Motorola publication. For the present invention, three such input/output modules are included.

The blocks 90 and 90' illustrate the respective creel information interface circuitry of the two sides 12, 14 of the creel and winder assembly 10 of the present invention and represent the input circuitry necessary to interface information received from the various creel sensors include a signal such as the "in-out" signals from the strand sensors or detectors 64, the package complete or "doff complete" signals, the "winder running" signals and other signals received when the "prep" buttons 52, 54 or 56 of the winder control panel 50 illustrated in FIG. 1 are manually pushed or depressed to indicate that one or more strand-serving packages have been prepped or prepared so that one or more stand-by strands are available for insertion upon computer command, as required. The creel interface blocks 90, 90' also represent the circuitry necessary to convert the microprocessor signals sent to the creel assemblies 16, 16', such as those designated as the "strand insertion" signal, "tension control" signal, and various other signals sent out by the microprocessor 70 to control the deflation and inflation of the mandrel supporting the collet 28, as known in the art, in order to remove a completed product package 30 and/or to prepare a new collet 28 on the mandrel for forming a new product package, as desired.

The entire microprocessor-based control system of the present invention operates in response to interrupt signals generated every one-tenth of a second. The periodic sequence of the interrupt signals are generated by the timer module of block 92 which receives a sixty cycle input and generates a periodic sequence of precision timing pulses every one-tenth of a second which acts to provide the necessary program interrupts to the microprocessor 70 in order to enable it to operate in an interrupt-driven mode to scan the entire creel and winder system 10 for data inputs and output the required control signals each one-tenth of a second.

Basically, the timer module of block 92 converts the sixty cycle AC input signal via a counter and uses the counted number to program a programmable Peripheral Interface Adapter (PIA) to send out an interrupt request flag signal to the microprocessor 70 each one-tenth of a second to control the operation thereof, as known in the art. The timer module circuitry of block 92 further includes an ASYNCHRONOUS COMMUNICATIONS INTERFACE ADAPTER (ACIA 6850) device which is basically a conventional interface arrangement for processing sequential or serial output data for such output devices as teleprinters, CRT's, or the like and similar devices. The ACIA 6850 device is further described in more detail in the above-identified Motorola publication.

Figure 4:
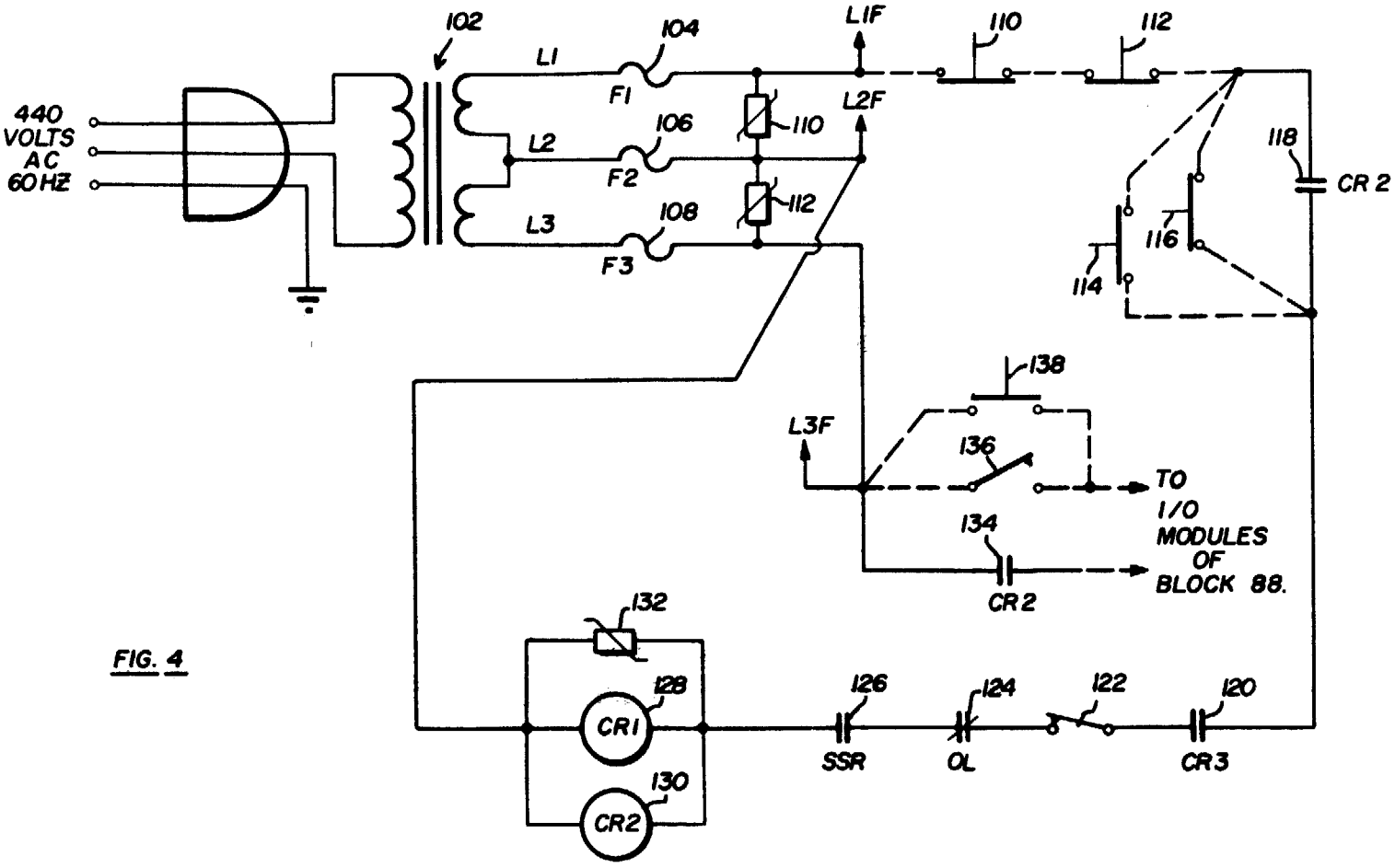
FIG. 4 is an electrical circuit diagram of the contents of block 82 of FIG. 3 and represents the roving winder panel circuitry together with the safety circuitry and power distribution circuitry of the system of FIG. 3.

FIG. 4 illustrates in schematic form the power supply input to the roving process system of the present invention and illustrates how such input is transformed into the various levels needed for the present system including a circuit diagram showing various stop and start switches located on the winder panel and on the control panel, as well as thermostatic overload protection switches and other safety devices necessary for the safe operation of the system external to the microprocessor 70. The input power supplied is typically 440 volts AC current at sixty Hz which is converted by the action of transformer 102 into a 220 volt AC source which is tapped at its center to form power lines L1, L2, and L3 to supply both the 110 volt and 220 volt AC requirements of the system.

Three fuses, 104, 106 and 108 are used to control the current supplied to prevent circuit overload, as known in the art. The fuses 104 and 108 are 20 amp fuses which are used to control the 220 volt supply to limit the current through all 220 volt devices to 20 amps while the fuse 108 is a five amp fuse which effectively limits the 110 volt sources to five amps as required for conventional safety purposes. Noise limitation is provided by conventional noise suppressors 110 and 112 operatively coupled between the power lines L1, L2 and L3, respectively. The noise suppressors 110, 112 may be any of the number of types of readily available commercial products such as a GE-MOV VI000L A000B. The signal designations L1F, L2F and L3F are used to denote power supply points and will be designated as such in the remainder of the figures to indicate fuse-protected sources of AC power. At FIG. 3, the dashed lines are used to indicate wires or other circuitry actually located external to the roving winder control panel of block 82 while the solid lines indicate those leads or wires which supply power to circuits available on the control panel of the roving winder 46 itself.

The dashed line illustrating the power input L1F is shown as being connected to a normally-closed switch 110 which is physically located on the creel display and control panel of block 84 as a "stop" button, as hereinafter described. The next series-connected switch 112 is also a normally-closed stop switch which is physically located on the winder 46 itself and which may be manually-operated by depressing a corresponding push button to open the switch 112 and break the series circuit path to stop the operation of the winder 46. From the switch 112, the circuit is serially connected to the parallel combination of three separate switching branches. A first switching branch includes a normally-opened switch 114 which corresponds to a "creel start" switch physically located on the creel display and control panel of block 84; a second branch connected in parallel with the first branch includes a normally-opened switch 116 which is a "start" switch physically located on the winder 46; and a third branch connected in parallel across the first and second branches includes a pair of normally-open relay-operated contacts which are designated CR2 to indicate that the contacts 118 are operated by the relay CR2, as hereinafter described. The contacts 118 act as holding contacts whenever the CR2 relay is energized, as known in the art.

The parallel combination of devices 114, 116 and 118 are then serially connected to another pair of normally-open relay-operated contacts 120, also designated CR3, which are normally-closed when power is supplied to the field windings of the winding motor 48 and therefore the relay CR3, to be hereinafter described, is energized to maintain the contacts 120 in a normally-closed or conducting position to permit continued running or operation of the roving process. Switch 122 is a normally-closed safety-type pack limit switch which operates as a separate device from the normal pack complete or "doff complete" limit switch as hereinafter described. The pack limit switch 122 provides an additional safety device which may be used to override the microprocessor commands which normally control the size of the product package being formed. Likewise, the normally-closed relay-operated contacts 124 act as an overload-type protection device which is thermostatically controlled by a heat-sensitive device to act as an excess heat safety circuit. When excess heat is detected, the normally-closed contacts open, thereby breaking the circuit to shut down the process. A solid state relay contact switch 126 is controlled by the microprocessor 70 which reads a "run request" signal from a digital input circuit board to command the closing of a solid state relay. This relay contact switch is located on the creel control panel of block 85, as hereinafter described.

When contacts 126 have been closed, relay CR1 and CR2 (128 and 130, respectively) are energized. The energized relay 128 closes the CR1 contacts located in block 80 for controlling the current to the armature of the motor 48, as hereinafter described. The L3F input is supplied to yet another parallel combination of three branches. A first branch includes a normally-open relay-operated CR2 pair of contacts 134. The energizing of the CR2 relay 130 closes the normally-open contacts 134 coming off the L3F input which gives a "winder running" signal to the microprocessor 70 via the input/output module of block 88. A noise suppressor 132 is similar to the above-discussed noise suppressors 110 and 112. A second parallel branch coming off the L3F terminal includes a normally-open limit switch 136 and the third parallel branch from the L3F input includes a normally-open switch 138 which sends a "doff complete" signal to the microprocessor 70 indicating that the package is complete in that it is to be stopped at its present size. The switch 138 represents a "DOFF" push button which is physically located on the winder 46 for manual operation when termination is desired. As can be seen, the "doff complete" signal which is sent to the microprocessor 70 is a 110 volt signal which must, therefore, first be properly interfaced, as hereinafter described.

The solid state relay contacts 126 are connected in series with another 3 branch parallel circuit having a first branch which includes a relay CR1, designated by reference numeral 128 and a second branch which is connected in parallel with the first branch and which includes a relay CR2, designated by the reference numeral 130. Lastly, the parallel combination includes a third branch connected in parallel with the first and second branches and which includes a conventional noise suppressor 132. The opposite terminal of the three parallel branch combination is connected in series to receive the previously described power input L2F.

Figure 5:
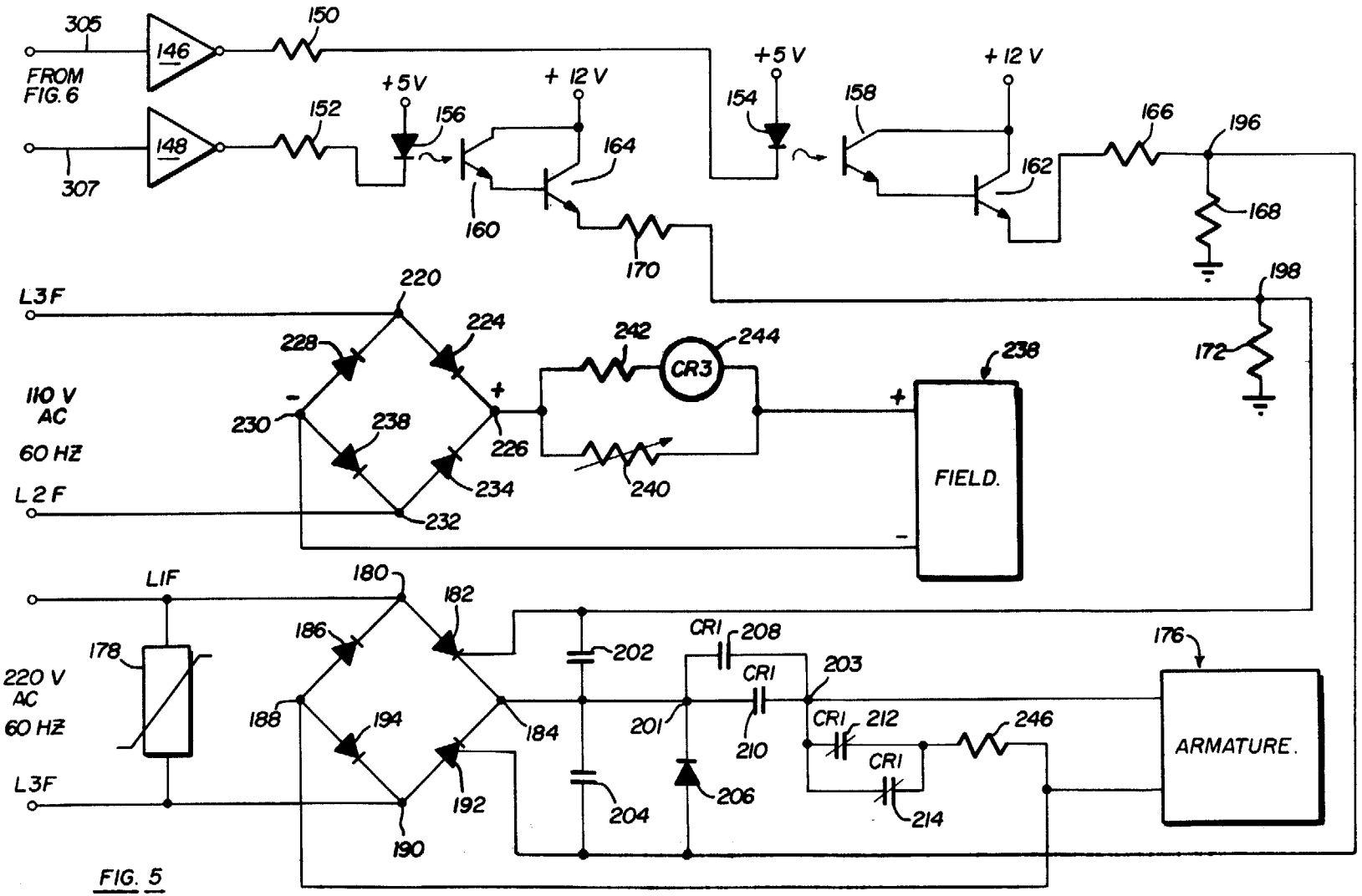
FIG. 5 is an electrical schematic diagram of the winding motor control circuitry of block 80 of FIG. 3.

The winder motor control circuit of block 80 is illustrated in the circuit diagram of FIG. 5 wherein the computer-generated motor speed control pulses are received from the speed control interface circuitry of block 76. The received motor speed control input pulses are processed along two substantially identical series circuit paths. Two separate series paths are necessary because the control SCRs are required to fire at a precise predetermined time after a positive half sign wave and after a negative half sign wave. The positive and negative motor speed control input signals are fed to corresponding inverters 146 and 148 and then through series resistors 150 and 152 to light-emitting diodes 154 and 156 whose functions is to turn on photo transistors 158 and 160, respectively which serve as optical isolators, as known in the art. The input signals are then amplified via Darlington-configured transistors 162 and 164 and are fed to voltage divider circuits formed by the combinations of two pairs of resistors 166, 168 and 170, 172, respectively. From the voltage divider circuits, each SCR firing pulse is fed to the respective sides of an SCR bridge rectifier circuit 174 associated with the motor armature 176, as hereinafter described. The light-emitting diodes 154 and 156 are biased by a +5 volt source and the output transistor circuitry, which is configured as a conventional Darlington amplifier, has a +12 V supply used as a bias.

The armature circuit includes a 220 volt AC source obtained from the inputs L1F and L3F referred to in FIG. 4 through a noise suppressor 178 connected between the L1F and L3F inputs. The L1F input is then connected to a first input node 180 of a bridge circuit 174. Input node 180 is connected to the anode of a first SCR whose cathode is connected to a first output node 184 and simultaneously to the cathode of a diode 186 whose anode is connected to a second output node 188. The L3F input is connected to a second input node 190 of the bridge circuit 174. Input node 190 is connected to the anode of a second SCR 192 whose cathode is connected to the first output node 184 and to the cathode of a diode 194 whose anode is connected to the second output node 188. A gate electrode of the first SCR 182 is connected to the junction 198 of the first series circuit voltage divider comprising resistors 170, 172 and the gate electrode of a second SCR 192 is connected directly to the voltage divider junction 196 of a second series circuit voltage divider comprising resistors 166, 168, respectively.

The positive and negative cycle SCR firing pulses are fed to the gate electrodes of SCR's 182 and 192, respectively, with capacitors 202 and 204 being connected between the first output node 184 and the first and second series paths to the gates of the SCR's 182 and 192, respectively. The capacitors 202 and 204 act as filters for improved isolation. Diode 206 is connected between the first and second outputs 184 and 188 of the SCR bridge circuit 174 and it functions as a free-wheeling diode which is used to provide a short circuit for the energy of the armature 176 of the motor 48 when slow-down is required. The output of the SCR bridge circuit 174 is supplied to the armature 176 and is a DC voltage signal varying in magnitude between zero and 200 volts with a maximum current of 15 amps which, in turn, may be used to speed up or slow down the speed of the winder motor 48 and its associated motor-driven collet 28.

The first SCR rectifier bridge output node 184 is connected to a node 201. Node 201 is connected to a first or positive armature input node 203 through the parallel combination of a first path including a normally-open relay-operated switching contact 208 and a second path parallel with the first path and including a normally-open relay-operated switching contact 210. The positive armature input node 203 is connected to one terminal of a dynamic braking resistor 216 through the combination relay-operated switch contact 212 connected in parallel with the second parallel path which includes normaly-closed relay-operated switching contact 214. The opposite terminal of the braking resistor 216 is connected to the second or negative input of the armature 176 and directly back to the second SCR rectifier bridge output node 188.

As briefly discussed in conjunction with FIG. 4, two pairs of relay-operated contact switches 208, 210 and 212, 214 act in conjunction with the dynamic braking resistor 216 to provide for a slow-down or dynamic braking of the armature 176 when power is shut off in the main circuit for any of several reasons. Therefore, when contacts 212 and 214 are closed, the remaining pair of contacts 208 and 210 are open and visa versa. When contacts 212, 214 are closed and contacts 208 and 210 are open, the power supply is removed from the armature 176 and the braking resistor 216 is connected in parallel with the armature 176 to provide a dynamic braking effect to slow down the motor 48.

Also shown in FIG. 5 is the field circuit for the field windings of the motor 48. The 110 volt AC input source is supplied via inputs L3F and L2F of FIG. 4. The L3F input is connected to a first input node 220 of a conventional bridge rectifier circuit 222. Input node 220 is connected to the anode of a diode 224 whose cathode is connected to a first or positive bridge output node 226 and to the cathode of a diode 228 whose anode is connected to the second or negative bridge output node 230. The L2F input is connected to the second input node 232 of the bridge circuit 222 and node 232 is connected to the anode of the diode 234 whose cathode is connected to the positive bridge output node 226 and is further connected to the cathode of a diode 236 whose anode is connected to the negative bridge output node 230. The positive bridge output node 226 is coupled to the positive input of the motor field winding 238 through the parallel combination of a first path including a variable resistor 240 and a second path parallel to the first path comprising the series combination of a resistor 242 and the CR3 relay 244.

The variable speed resistor 240 is connected in parallel to resistor 242 and the CR3 control relay 244 for providing DC power to the field windings 238 of the motor 48. As previously discussed in conjunction with FIG. 4, the CR3 control relay 244 is energized when there is power to the field 238 so as to close the relay-operated contacts 120 of the circuit of FIG. 4. If the field windings 238 should burn out or the like, the CR3 control relay 224 will immediately de-energize and drop out causing the normally-opened relay-operated contacts 120 to open thereby braking the current path to the motor by causing an open circuit condition to shut off the supply of power to the system.

Figure 6:
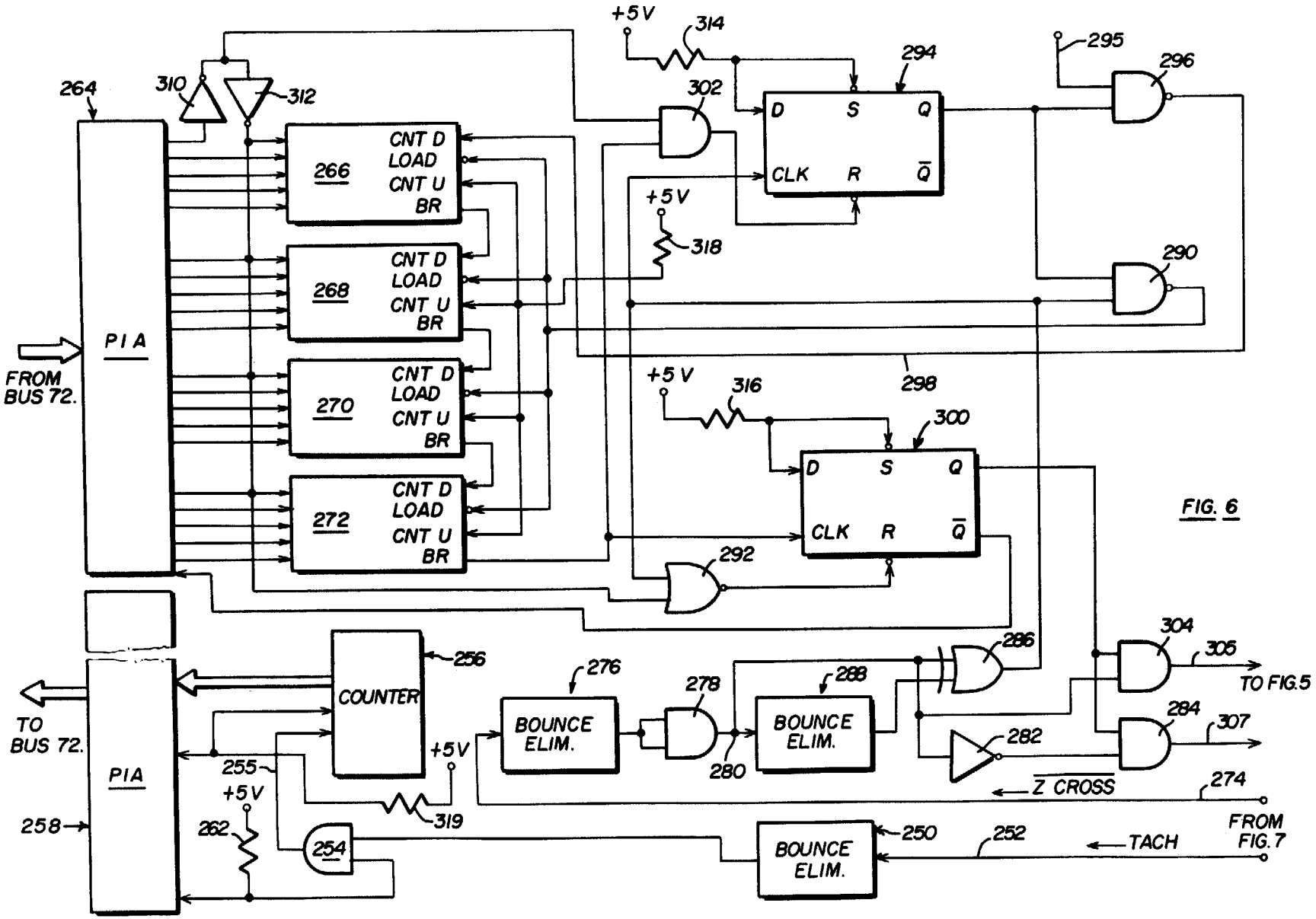
FIG. 6 is a circuit diagram, partially in block form, of the SCR control input/output module circuitry of block 74 of FIG. 3.

FIG. 6 details the SCR control input/output circuitry of block 74 of FIG. 3 and is adapted to receive tachometer pulses and the zero-crossing detection pulses from the speed control interface circuitry of block 76 to output the SCR firing pulses to the winder motor control circuit of FIG. 5, as previously described. Although two sets of tachometer signals and zero-crossing detection signals are supplied because of the use of the two sides 12, 14 of the creel and winder assembly 10 of the present invention, only one of such sides will be considered for the purpose of simplifying the description of the present invention and the required circuitry for the opposite side will simply be duplicated where appropriate, as known in the art.

The tachometer signals from the speed control interface circuitry of block 76 is fed to a conventional bounce eliminator circuit 250, such as a commercially available off-the-shelf Motorola MC 14490 Hex contact bounce eliminator which is a standard four-bit shift register wherein the input data must be stable at the input for at least four clock times, or approximately four microseconds in the present embodiment, before the input signals will be passed to the output and gated, as known in the art. The bounce eliminator 250 receives the tachometer output pulses from the speed control interface of block 76 via lead 252 and is used for isolation purposes, as known in the art. For the required isolation purpose, a grounded capacitor in combination with a Schmitt trigger could accomplish essentially the same purpose as could a number of other well-known isolation circuits familiar to those skilled in the art.

The signal from the bounce eliminator 250 is fed to one input of a logical AND gate 254 whose output is fed via node 255 to the input of a ripple counter 256 which counts the accumulated tachometer pulses until a signal is received from the Peripheral Interface Adapter (PIA) 258 to provide a low signal to disable the second input of AND gate 254 and stop the counting of the ripple counter 256. The output of the PIA 258 is supplied to the input of an inverter 260 which is also connected to ground to a resistor 262. Simultaneously, with the stopping of the counting operation, the PIA 258 accepts the stored count from the ripple counter 256 and proceeds to enter the accumulated count to the data bus 72 where the microprocessor reads the count information and uses it in preprogrammed calculations employed to generate the required SCR firing control pulses necessary for speed correction and the like which are then sent out via the data bus 72 to a second PIA 264.

Before discussing the operation of the PIA 264 and its loading of a computer-calculated count into the four counter stages 266, 268, 270 and 272, it is helful to analyze just what is being entered or preset into these counters and the relationship of the preset count to the SCR firing pulses which are outputted. Using a one megahertz clock signal which is conventionally provided with the M6800 microprocessor 70, a 60 cycle, 110 volt source such as that used in a preferred embodiment of the present invention provides sufficient time for 8333 timing clock pulses to be outputted from the microprocessor 70 for each half cycle or half wave form of the 60 cycle signal.

Taking the positive cycle or half wave form, for example, if the number 8333 was to be preset or preloaded into the four counter stages 266, 268 270 and 272 by the PIA 264 and if this preset or preloaded count was then counted down to zero to generate the required SCR firing signal, there would be no power delivered to the motor, for by the time the counter stages 266, 268, 270 and 272 were counted down to zero, the amplitude of the input wave form would also have reached zero as the particular cycle of the 60 cycle wave form signal will already have or will currently be going through its positive (or negative) amplitude phase transistion and have reached the zero-crossing point again. Therefore, since power is an integration of the area under the amplitude curve, the lower the number preset or preloaded into the counter stages 266, 268, 270 and 272, to be counted down, the greater would be the increase in power supplied to the motor 48. For example, if the number preloaded into the counter stages 266, 268, 270 and 272 were 5,000 this would indicate that the area under the curve from the initial count of 5,000 to the final count of 8333, or essentially the second one-third of the particular half cycle or curve, would be the amount of power delivered to the armature. Likewise, if the number zero were loaded, the full amount of power available under the curve would be provided since power would be supplied during the entire half wave cycle and fed to the armature to provide the fullest amount of power possible for driving the winder motor 46, as known in the art.

Thus, the number computed by the microprocessor 70 in response to the input information, including the tachometer signals and the programmed speed functions to which the computed or measured motor speeds are compared for a given number of operating strands actually being wound, produces a binary number somewhere between zero and 8333 which is preloaded into the appropriate counter stages 266, 268, 270 and 272. The second input signal from the speed control interface of block 76 which relates to the zero-crossing points is an inverted signal. Therefore, when the second input signal is an indication of a zero-crossing on the positive half wave form or cycle, a zero or low signal exists on the input lead 274 coming from block 76 and this signal is fed to a second contact bounce eliminator 276 similar to the contact bounce eliminator 250 previously described. The output of the contact bounce eliminator circuit 276 is connected to both inputs of a logical AND gate 278 to provide a driver circuit which supplies the output of the bounce eliminator circuit 276 to a node 280. The signal from node 280 is fed to one input of a logical AND gate 284 through an inverter 282. Node 280 is also connected to one input of an Exclusive OR gate 286 and to the single input of yet another contact bounce eliminator circuit 288 whose output is connected directly to the other input of the Exclusive OR gate 286. The purpose of the contact bounce eliminator circuit 288 in the present application is to provide the required four microsecond delay previously described. Since the high or low signal produced by the zero-crossing detector of block 76 will be de-bounced and eventually fed to both inputs of the Exclusive OR gate 286, the output of the Exclusive OR gate 286 which will only produce a high signal when the bounce eliminator 288 is used to delay the incoming signal by the four microseconds delay time to allow a four microsecond period during which a signal may be outputted from the Exclusive OR gate 286 for each detected zero-crossing or transistion between the positive and negative cycles of the input wave form.

In other words, when a speed control signal is outputted from speed control interface circuitry of block 76, it is delayed for a short time (four microseconds) by the contact bounce eliminator 288, and during that delay period, the exclusive OR gate 286 will receive dissimilar inputs resulting in the production of a four microsecond high output signal at the output of the Exclusive OR gate 286 which is fed simultaneously to one input of NAND gates 290 and 292 as well as to the clock input of a D-type flip-flop 294. When the high pulse reaches the clock input of flip-flop 294, it toggles the flip-flop such that the non-inverting or Q output goes high causing the output of NAND gate 290 to produce a low since the opposite input to NAND gate 290, which is taken directly from the output of the Exclusive OR gate 286, was already high for enabling same. The low output from NAND gate 290 is fed to the load input of the counter stages 266, 268, 270 and 272 which, as indicated, are activated by a low signal for loading or presetting the computer calculated count therein. The Q output of flip-flop 294 also enables NAND gate 296 to permit countdown pulses from the one megahertz clock associated with the microprocessor 70 to be gated or passed via lead 295 to the enabled NAND gate 296 whose output supplies these clock pulses via lead 298 to count down the count loaded into the counter stage 266 previously described.

When counter stage 266 is counted down to zero, a borrow signal is generated on the next count to begin counting down the next counter stage 268 and this tool will continue until it sends out a borrow signal to begin counting down the third counter stage 270 and so on until the borrow signal from the final counter stage 272 sends out a low signal which is passed to the clock input of a D-type flip-flop 300 and to one input of a logical AND gate 302. The low clocking signals supplied to flip-flop 300 toggles the flip-flop and causes the signal at the non-inverting Q output, which is used to output a motor speed control signal via logical AND gate 284 and 304 to produce the SCR firing control pulses via the circuitry of FIG. 5, as previously described.

The low output of the borrow signal from the final counter stage 272 is also fed to one input of a logical AND gate 302 which causes it to generate a low signal at its output and this low is supplied from the output of AND gate 302 to the reset input of flip-flop 294 to reset the flip-flop and cause the Q output to go back to its initially low level to prevent any further down counting of the counter stages 266, 268, 270 and 272. The other input to the logical AND gate 302 is a continuously high signal from the PIA 264. This provides a method for stopping the counting process under microprocessor command. In other words, the signal supplied to the second input of logical AND gate 302 from the PIA 264 via the output of inverters 310 will be high at all times unless otherwise commanded by the microprocessor 70 because a low signal will terminate the counting procedure by producing a low at the output of AND gate 302 for resetting the flip-flop 394 as previously described.

The output signal of PIA 264 which is used to stop the counting process via AND gate 302 is also inverted again and fed to gate the second input of NOR gate 292. The other input to the NOR gate 292 is the output of a previously described Exclusive OR gate 286. Therefore, because a low input is required to reset the flip-flop 300, the NOR gate 292 will pass the required low reset signal only when one of its inputs, either from the PIA 264 through the series connected inverters 310 and 312 or the output of the Exclusive OR gate 286 is high. Therefore, flip-flop 300 can only be rest when the PIA 264 indicates that the microprocessor 70 has commanded the termination of the counting operation by presenting a high signal to the input of inverter 310 or when the output of the Exclusive OR gate 286 produces a low pulse evidencing a detected zero-crossing or transistion from positive to negative or negative to positive half cycles at the input wave form.

The D inputs of the flip-flops 294 and 300 are permanently biased high via the pull-up resistors 314 and 316, respectively, which have one terminal connected simultaneously to both the D inputs and the set inputs thereof and its opposite terminal connected to a +5 V source of potential. This high signal which is also supplied to the set input of the flip-flop 294 and 300 is important since the flip-flops 294, 300 require a low signal in order to set the flip-flops 294, 300 and therefore, the flip-flops 294 and 300 can never be set. This provides a way of permanently disabling the set inputs of the flip-flops. The PIA shutdown signal from the microprocessor 70 is first fed to the input of an inverter 310 after which it is connected to the second input of logical AND gate 302, as previously described and to the input of a second inverter 312 whose output is supplied to the second input of NOR gate 292. This permits control over the reset function of both flip-flops 294 and 300 for disabling them, when desired. The count-up counter stages 266, 268, 270 and 272 have their count-up input connected to a +5 V source of potential via resistor 318 to permanently keep the count-up inputs in a high state which does not permit transistions.

It should be noted that the outputs of logical AND gates 284 and 304 are enabled by the zero-crossing signals for the positive and negative cycles, and are produced by input signals which are the same except for the presence of an inverter 282 at one input of AND gate 284 which is used to distinguish between the positive and the negative zero-crossings. For example, when the inverter 282 is in operation to provide a high signal to enable AND gate 284, a Q output of flip-flop 300 goes high, it will be passed or gated through the enabled AND gate 284 but not through disabled AND gate 304 whose opposite input is disabled by the low signal presented to its other input via node 280. AND gate 304 is therefore disabled by the non-inverter zero-crossing signal so that the Q output of flip-flop 300 is not gated to the external circuitry so that the enabling of AND gates 284 and 304 is alternated between positive and negative half cycles so that the outputs of the positive and negative SCR firing pulse-generating AND gates 284 and 304 which were connected via leads 304 and 307 respectively to the inputs of the previously described circuit of FIG. 5 to provide the necessary SCR firing control signals.

Figure 7:
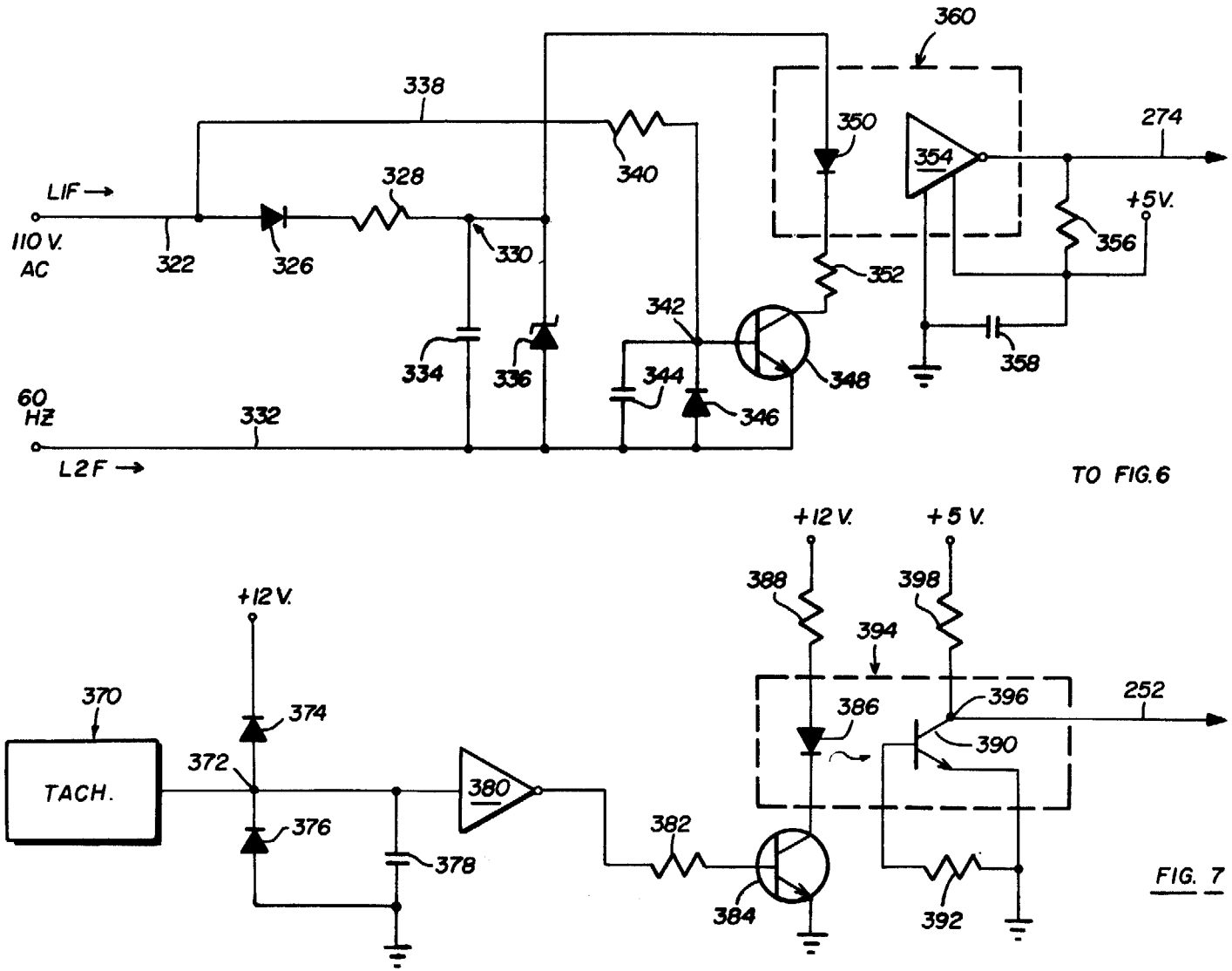
FIG. 7 is an electrical circuit diagram of the speed control interface of block 76 of FIG. 3 which generate the tachometer pulses and the zero-crossing detection pulses used for control purposes in the system of the present invention.

FIG. 7 illustrates the speed control interface circuitry of block 76 of FIG. 3 which is used to produce a tachometer signal and the zero-crossing detection signals sent to the SCR control input/output module of block 74 as previously described in FIG. 6. The zero-crossing detector and associated interface circuitry 320 of block 76 is shown as having a 110 volt AC source connected thereto via the signal inputs L1F and L2F, as previously described. The L1F input is fed via lead 322 to an input node 324. Node 324 is connected directly to the anode of a diode 326 whose cathode is serially connected through a resistor 328 to a node 330. Node 330 is connected to the L2F input lead 332 through a capacitor 334 and through a zener diode 336 whose cathode is connected to node 330 and whose anode is connected to lead 332. The combination of resistor 328 and capacitor 334 acts as a conventional input filter. The L1F input is also supplied via lead 338 and a series resistor 340 to a base input node 342. The base input node 342 is connected (1) through a filter capacitor 344 to lead 332; (2) to the cathode of a diode 346 whose anode is connected to lead 332; and (3) to the base of a conventional NPN transistor 348.

The emitter of transistor 348 is connected to the L2F input lead 332 and to the base of the zener diode 336 which is, in turn, connected to the anode of the light-emitting diode 350. The collector of transistor 348 is connected through a resistor 352 to the cathode of the light-emitting diode 350. The light emitting diode (LED) 350 conducts to emit light and turn on an amplifier circuit 354 which outputs the zero-crossing detection signal previously described on output lead 360 which is supplied to the circuit of FIG. 6 via lead 274, as previously described. Bias to the amplifier circuit 354 is provided by a +5 V source of potential and a pull-up resistor 356 which is connected together with a capacitor 358.

Tachometer signals produced by a conventional magnetic tachometer or the like, as represented by block 370, are supplied to an input node 372 of the tachometer circuitry 368 of FIG. 7. Filtering and isolation is provided by a pair of diodes 374 and 376 as well as a filter capacitor 378. Input node 372 is connected to the anode of diode 374 whose cathode is connected to the +12 V source of potential. Node 372 is further connected to the cathode of a diode 376 whose anode is grounded and to one plate of a capacitor 278 whose opposite plate is grounded. The input signal from node 372 is also supplied directly to the input of an inverter 380 whose output is connected through a resistor 382 to the base of a conventional NPN transistor 384. The emitter electrode of transistor 384 is connected directly to ground while the collector output of transistor 384 is fed to the cathode of a light-emitting diode 386 whose anode is connected through a resistor 388 to a +12 V source of potential. LED 386 emits a signal to photo transistor 390 whose conduction or non-conduction outputs the signal to the SCR control input/output module of FIG. 6.

The emitter electrode of a photo transistor 390 is connected directly to ground while its base is connected to ground through a resistor 392. A circuit output is taken via lead 262 from a collector output node 396. Node 396 is also connected to a +5 V source of potential through a pull-up resistor 398, as known in the art.

The +5 source of potential in conjunction with the pull-up resistor 398 provides the necessary output base line signal levels at the output node 396, as known in the art. Furthermore, the +12 V source of potential together with the series resistor 388 provide the circuit path for the light-emitting diode 386 for operating same. In operation, the negative-going tachometer pulses are inverted by the action of inverter 380 and used to turn on switching transistor 384 which is operated in the switching mode and normally maintained in the non-conducting state. When transistor 384 is turned on by an inverted, negative-going tachometer pulse supplied to node 372 and inverted by inverter 380, LED 386 is turned on causing it to emit an optical signal. Photo transistor 390 responds to the presence of this optical signal and switches to a conductive state to complete a series circuit path between the +5 V souce of potential and ground via pull-up resistor 398, and the conducting transistor 390. This pulls the output node 396 and hence the signal on lead 252 to ground making the tachometer output signal low. Conversely, when the tachometer input signal supplied from the tachometer 370 to the input node 372 is high, the output of the inverter 380 goes low and switches transistor 384 back to its normal non-conducting state when the switching transistor 384 is rendered non-conductive, LED 386 ceases to emit light causing photo transistor 390 to be switched off. With the photo transistor 390 off, node 396 is no longer grounded and the combination of the +5 V source of potential and pull-up resistor 398 will raise the level of the output voltage at node 396 to a high so as to output a high tachometer pulse on output lead 252 to the circuit of FIG. 6 as previously described.

When the light emitting diode 350 of the zero-crossing detector circuit 320 of FIG. 7 is on, it emits radiation to turn on a photo transistor or the like in the amplifier 254 such as the photo transistor normally coupled in a Darlington configuration with a second transistor for application purposes. This produces the required zero-crossing signal on output lead 274. The combination of LED 350 and the amplifier 354 provides for optical isolation as known in the art, and the combination of LED 350 and amplifier 354, indicated by the dotted mark 360 as with the combination of LED 386 and photo transistor 390 enclosed within the dotted block 394 of the tachometer circuitry 368 are standard, off-the-shelf, commercially available devices. When the positive half wave cycle passes through resistor 340 and node 342 to the base of transistor 348, it charges up capacitor 344 until the base-to-emitter voltage of transistor 348 is exceeded to turn on or switch transistor 348 to a conductive state and establish a series conductive path through lead 322, diode 326, resistor 328, node 330, LED 350, resistor 352, the conducting transistor 348, and lead 332. With current flowing in this conductive path, LED 350 is turned on to emit radiation. When LED 350 is on, the emitted radiation turns on the photo detector in the amplifier 354 as previously described to produce the required zero-crossing detection signal to be outputted via lead 274. Conversely, when the incoming positive half cycle of the wave form signal goes into its negative half wave phase or cycle, the LED 350 turns off because transistor 348 is turned off due to the lack of current passing through its base electrode to establish the previously-described series circuit path through the LED 350. This causes the amplifier 354 to turn off and output a high on lead 274. Therefore, the actual zero-crossing detection signal is represented by the high-to-low or the low-to-high transistion occurring in the signal on lead 274 at the output of the amplifier 354 and this transistion occurs each half cycle since the negative half wave signal again passes through zero and goes into the positive phase or half cycle to cause the output of the amplifier 354 to undergo a transistion from high to low and begin the cycle anew as described above.

The light emitting diode 350 in combination with its associated amplifier 354, as previously described, represents a standard, commercially available circuit and provides a zero-crossing-indicative output signal which is optically isolated from the magnetic tachometer circuitry 370, the 110 volt AC source, and the like to provide a clean pulse having sharply-defined leading and trailing edges indicative of the transistions and hence the actually detected zero-crossing points such that the pulses outputted from the circuit of FIG. 7 via lead 274 to the circuit of FIG. 6, previously described, are relatively immune to interference and noise, of both a magnetic and an electrical nature.

Figure 8:
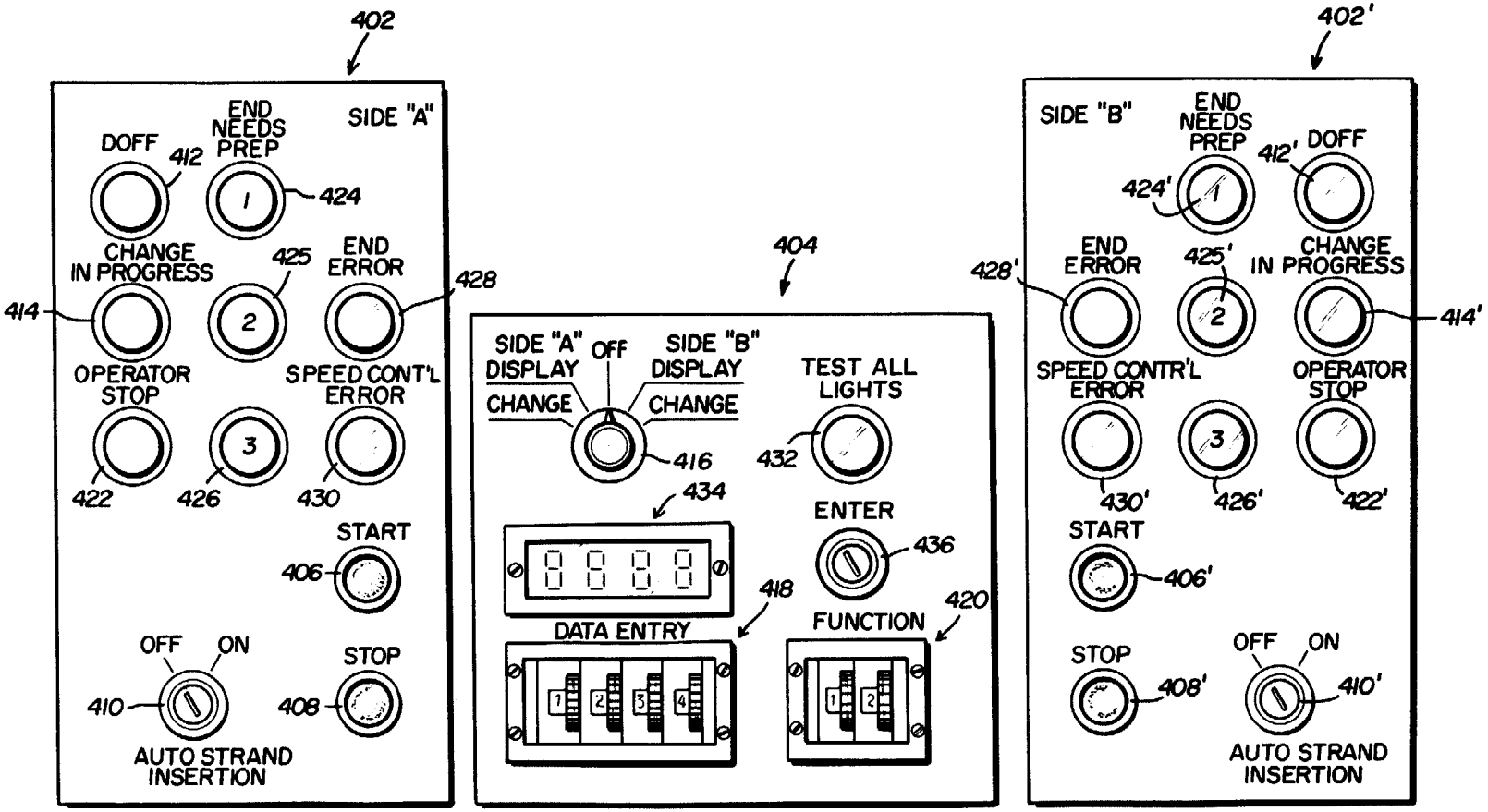
FIG. 8 illustrates the creel display and control panel of block 84 of FIG. 3.

FIG. 8 illustrates the creel display and control panel 400 of block 84 of FIG. 3 as having three distinct portions. A subpanel 402 provides a display and control apparatus for creel side A, represented by reference numeral 12 in FIG. 1, whereas the subpanel 402', which is substantially identical to subpanel 402, provides display and control information for the opposite creel side B, represented by reference numeral 14 of FIG. 1. Similar numbering will be used, wherever possible, to designate corresponding elements for the two sides 12, 14 in this application. The center panel portion 404 provides roving process data entry and function entry controls which are used to inform the microprocessor 70 of the requested functions and data entered for particular roving process and/or desired product package to be produced thereby.

Referring to block 402, a "start" button 406, corresponding to switch 114 in FIG. 4, and a "stop" button 408, corresponding to either switch 110 or switch 112 in FIG. 4, provide for overall operator control of the start up and shut down for the creel A side portion 12. These buttons were previously discussed in conjunction with the roving control and safety circuitry of block 100 of FIG. 4. It will be recalled that the dotted lines of FIG. 4 indicated that the push buttons or switches connected thereto were external to the control panel itself and indeed their correspondingly named designations in FIG. 8 indicate that their location is at a different point physically and electrically from the circuitry of FIG. 4 itself. The automatic strand insertion switch 410, which may be a conventional key lock switch or rotary switch, is used to enable and disable the automatic microprocessor control of the strand insertion solenoids associated with insertion devices 33, 34 and 35.

The remaining lights on subpanel 402 are status signals or indicators only and do not permit any operator control from the operator's creel station. The "DOFF COMPLETE" light 412 lights up in response to a signal sent to the microprocessor 70 from the pack limit switch 136 of FIG. 4 to indicate that the DOFF or product package has reached its designated size and that the roving process is to be stopped or shut down to change packages. The "change in progress" light 414 indicates that the rotary switch 416 on the central panel section 404 is in the "change" mode and the data is being entered via the data entry thumb wheel switches 418 or the function entry thumb wheel switches 420 to inform the operator that the winder 46 will not operate when the rotary switch 416 is in the "change" position. This must be so because the microprocessor is being fed new information and cannot respond properly to a running winder 46 as it is in the process of changing from one set of "rules" to another for running the system.

"Operator Stop" light 412 indicates that the operator, either at this particular panel or at the roving control panel previously described, pushed the "operator stop" button. This visually indicates to the operator that the reason for the system stoppage in the roving process has nothing to do with the microprocessor control system or that the number of ends or strands 20 from serving packages 18 is incorrect and non-correctable by automatic means. The three "end needs prep" buttons 242, 425, 426 indicates the particular number (1, 2, or 3 in the preferred embodiment of the present invention) of the strand-serving packages 18 that should be operator-prepared by having its strand 20 or end threaded through its corresponding strand guide 32 by the operator and carried over to the end of its row 22, 24, 26 to be placed in a "ready" or a "stand-by" state wherein it is available to be automatically inserted into the group 36, 38 or 40 of operating strands 20 from the individual rows 22, 24, or 26 by computer-generated "strand insertion" commands. This serves as a status monitor of the end prep buttons 52, 54 and 56, previously described.

When the operator prepares strand-serving package 18 by threading the individual strand 20 through the appropriate guide 32 and carries the strand to the end of the row 22, 24, 26 to the appropriate strand-insertion devices 33, 34 and 35, respectively, and then pushes the appropriate "preparation completed" button 52, 54, or 56 associated with the particular row 22, 24 or 26 of packages 18 for which the individual strand 20 has been prepared and placed in a "stand-by" condition, the appropriate "end needs prep" light 424, 425, or 426 on the panel portion 402 is turned off or extinguished. The "end error" light 428 indicates that the counted number of ends or operating strands 20 which are actually running or currently being gathered and wound and the desired number of strands 20 which are programmed in the microprocessor 70 for forming a particular product package are different, and therefore, the winding process will stop if there is an insufficient number of operator-prepared stand-by strands available for automatic insertion so that the equality condition can't be corrected.

Basically, this gives an indication as to why the process has stopped and alerts the creel operator to check the total available number of serving packages 18, or actually the total number of available strands which equals the sum of the counted number of operating strands 20 actually being gathered and wound plus the number of currently available operator-prepared stand-by strands available for automatic insertion if such is required by the microprocessor 70, or to check the strand insertion devices 33, 34 and 35 for a possible malfunction. The "speed control error" display light 430 indicates that the difference between the pre-programmed required motor or winding speed requested by the microprocessor 70 through the SCR control interface of FIG. 6 and the actual speed measured by the tachometer circuitry 368 of FIG. 7 exceeds a predetermined value causing the roving process to be shut down. It should be noted at this point that when reference is made to the system being shut down or stopped, it only applies to the particular A side 12 or creel B side 14 with which the error signal or stop signal is associated. That is, if the "operator stop" or speed control error light on the subpanel 402 is illuminated, it does not effect the operation of the creel B side 14 and all indicators on the subpanel 402' remain functional. Also, as stated before, similar push buttons and status indicators on the creel B side 14 of the system are similarly designated by the same reference numeral with a prime mark affixed thereto, when possible.

The function entry apparatus of the central panel portion 404 includes a rotary control switch 416 which, as previously discussed, switches between the "display"

state, used for normal status-monitoring operations, and the "change" state position, used for indicating that no data or function information is to be or is currently being entered into the microprocessor system 70. The rotary switch 416 also enables the creel operator to selectively control which of the sides 12, 14 is to receive the entered new information data. That is, the creel A side 12 may be displaying while the creel B side 14 is undergoing a change for data entry purposes. The "test-all-light" button 432 is merely a device for testing the operation of all status lights or visual indicators in the system for finding malfunctioning LEDs, burned out lights, or the like.

A data entry display 434 is associated with the manually-operable thumb wheel data entry switches 418 which provide the input data into the microprocessor 70 concerning changes necessitated when different products are to be formed. The switches 418 are, in the preferred embodiment of the present invention, conventional thumb wheel-type switches which control interface circuits to be hereinafter described. As a particular data entry is set or programmed by the manually-operated thumb wheel switches 418, the display 434 which may be, for example, conventional seven segment read-out devices indicating the selected decimal digits, visually displays to the operator for verification purposes the settings on the thumb wheel switches 418. Data entry switches 418 and display panel 434 provide for the entry of four binary-coded decimal inputs, however, the number of inputs may be varied to meet the application needs of a particular system, as known in the art.

The function switches 420 include two manually operable thumb wheel switches for entering two binary-coded decimal values which indicate to the microprocessor 70 where, in memory, it is to store the data which is currently to be entered. That is, it designates the particular function with which the entered data corresponds since the computer 70 operates in a memory-mapped manner, as known in the art. The "enter" switch 436 is a key-operated switch which can be manually turned by the creel operator to enter the preprogrammed data set on the thumb wheel switches 418 or 420 into the designated memory locations and represents the final step in the data entry process. The data and function entering process therefore includes first setting the appropriate thumb wheel switches 418 and functional switches 420 to program the appropriate binary coded decimal numbers representing the programmed data or functions to be entered; and finally turning the entry switch 436 to the enter position to actually enter and lock the selected or programmed data and functional information into the microprocessor system 70.

Then, when the change switch 416 is turned back to the display mode, the microprocessor 70 begins to operate using the newly-entered data and functional information. The physical location for the control panel sections of FIG. 8 is a mere matter of choice and convenience, depending upon the operation of the system, the physical environment in which it was used, and the like. It may, for example, be part of the creel set up itself or it may be remotely located, depending upon the particular needs of the operation, the set-up of the plant, etc. The display and control segments of the subpanels 402, 402' for the two sides 12, 14 of the creel and winder assembly 10 of the present invention do not, in the main, communicate with the microprocessor 70 as such. In other words, the various creel sensors are monitored and the flow of information is controlled by means of the input/output modules of block 88 where the interface circuitry is shown. Basically, the display devices or status indicators of the panel sections 402, 402' and the like are mere monitors or status indicators of the output information supplied to and from the microprocessor 70, and the creel interface of blocks 90, 90' or, as in the case of the "end needs prep" lights, the status monitor of the winder panel 50. This being the case, various displays on the various panels or panel sections may be considered as mere electrical extensions of the creel interface circuitry of blocks 90, 90' of FIG. 3 which will be described in conjunction with the detailed circuitry of FIG. 10.

Figure 9:
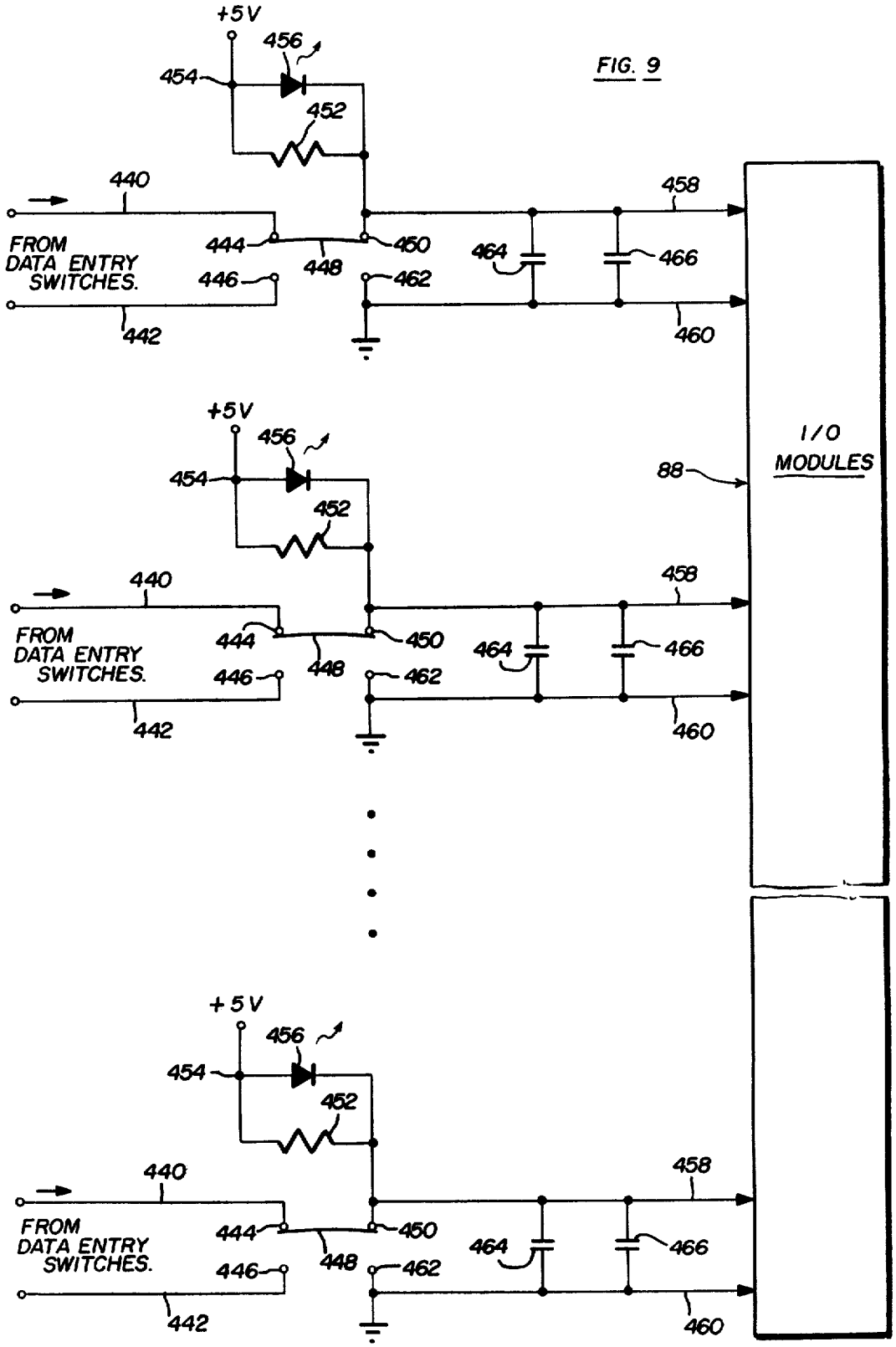
FIG. 9 shows the electrical circuit diagrams for the creel control data entry means of block 86 of FIG. 3.

Having related subpanels 402 and 402' to the creel interface circuitry of blocks 90 and 90' of FIG. 3, a description of the circuitry of FIG. 9 is in order. FIG. 9 shows, in abbreviated form, some of the creel control panel data entry circuitry for entering the data set by the thumb wheel switches 418, 418' and the function switches 420, 420' of FIG. 8. The circuit illustrated in FIG. 9 represents one of a multiple of substantially identical circuits necessary to enter the manually preprogrammed or selected functional information determined by the positions of the two thumb wheels of the function switch 420 and the selected data entered by the four thumb wheel switches of the data entry switch 418 and both function and data information is entered in binary-coded decimal form. Due to multiplicity, only a portion of the six individual circuits which would be required to enter the selected information from the four data thumb wheel switches 418 plus the two functional thumb wheel switches 420 are shown in detail and discussed but it will be understood that any number of such circuits could be used depending upon the number of data or functional entries desired.

Information is entered via the corresponding decimal-numbered thumb wheel switches of data switch assembly 418 and function switch assembly 420 on input leads 440 and 442 with lead 442 being grounded at input node 446 and input node 444 of input lead 442 being connected via a jumper 448 to a node 450 which provides current to one terminal of a resistor 452 whose opposite terminal is connected to a power supply node 454 which is directly connected to a +5 V source. The power supply node 454 is also connected directly to the node of an LED 456 whose cathode is connected back to node 450 to place the LED 456 in parallel with the resistor 452. A first output lead 458 couples node 450 to one input of the I/O modules of block 88 of FIG. 3, as hereinafter described, and a second output lead 460 connects a grounded node 462 to a second input of the I/O modules of block 88. First and second capacitors 464 and 466 are connected in parallel with each other between output leads 458 and 460, respectively.

The biasing for the circuit is provided by the +5 V source of potential, as known in the art. Capacitors 464 and 466 act as conventional filters and the output signal, indicative of the entered data, is supplied or entered into the input/output modules of block 88 for supplying the appropriate binary-coded data or functional information to the microprocessor 70. The light emitting diode 456 may be used for eliminating the entered digits of information on the data entry display panel 434 of the central panel portion 404 illustrated in FIG. 8, or it may be used as a trouble shooting indicator located on the back of the panel for diagnostic purposes or the like. As previously described, all other data transfer, both to and from the microprocessor 70, will be treated as part of the creel interface circuitry of blocks 90, 90'. However, it is a matter of preference in so treating it for the creel control panel entry and display of FIG. 8 and the creel interface circuit of FIG. 9 both constitute entry points to the input/output modules of block 88. Therefore, the location of a particular entry or output to or from the microprocessor 70 is a matter of preference only.

Figure 10:
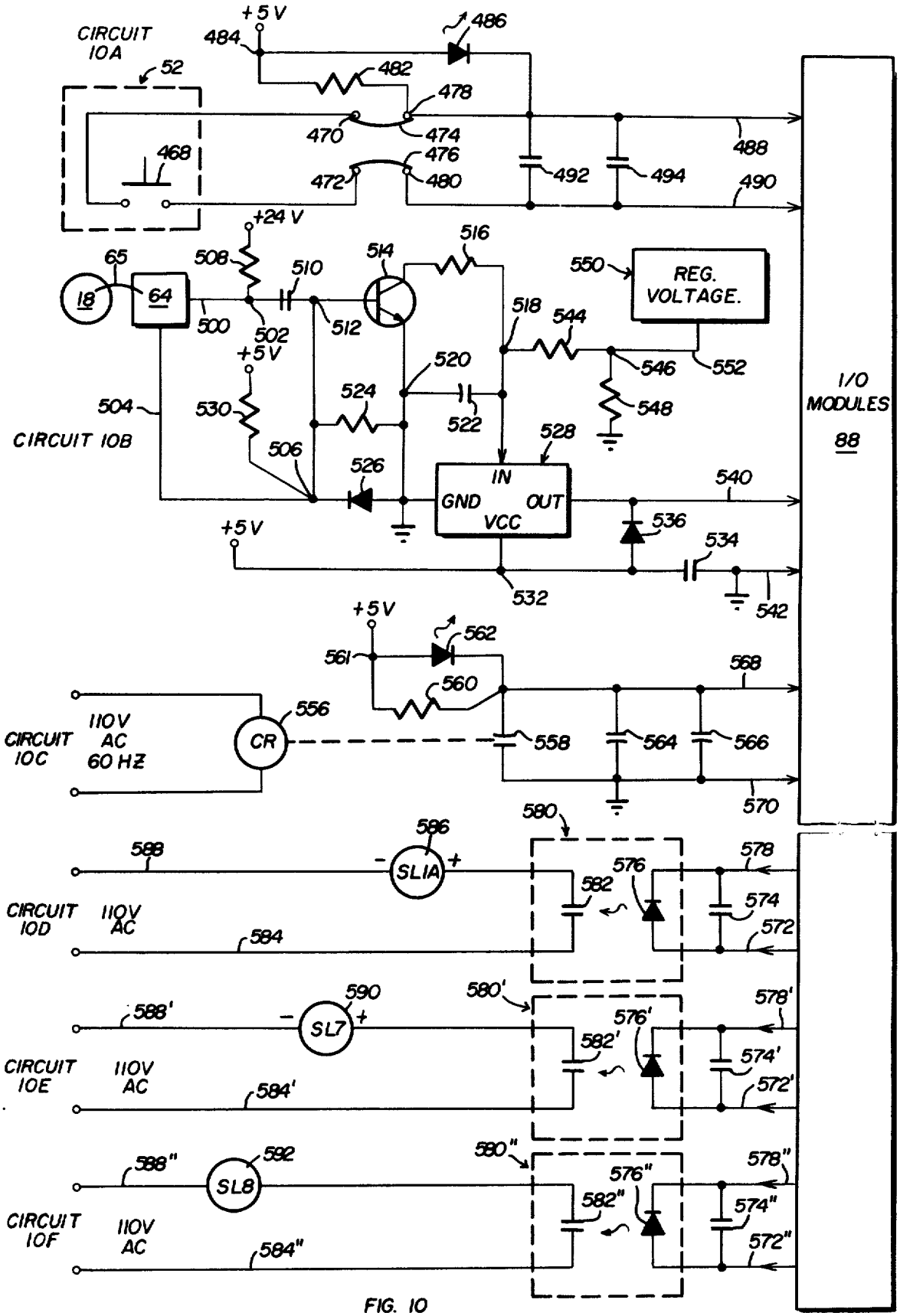
FIG. 10 is a schematic diagram of the creel interface block 90 of FIG. 3 and generally shows the input and output interface circuits for interfacing between the creel and the microprocessor of the present invention iva the I/O modules of block 88 and the data block 72 of FIG. 3.

The creel interface circuits of blocks 90, 90' will now be described with reference to the circuitry of FIG. 10 which includes 3 different types of signals to be inputted to the microprocessor 70, represented by circuits 10A, 10B, and 10C and three different types of output signals to be interfaced with the microprocessor 70, as illustrated in circuits 10D, 10E and 10F, as hereinafter described.

In operation, the output of transfer 64 may be the result of a photo optical Darlington-connected transistor amplifier circuit used to detect when there is an end out condition or break in the strand 20. Normally, when an operating strand 20 is running or being pulled from its associated serving package 18 for winding purposes, a first constantly varying amount of light is supplied back to the light-detecting circuitry 64 via a fiber optic rod or lead 65 causing the detector 64 to output a continuously varying signal on lead 500 indicating a detected operating strand 20 which allows capacitor 510 to charge to a point where transistor 514 is switched on to a conductive state. With transistor 514 switched on to a conductive state, capacitor 522 is unable to charge to a sufficient voltage level to turn the Schmitt trigger device 528 and hence the output of the Schmitt trigger device 528 is normally low to indicate that the presence of a running or operating strand 20 has been detected. The voltage regulator 550 is useful in allowing for selective control of the RC time constant of this circuit to determine the rate at which the capacitor 522 is charged and therefore for determining the time after which an end out or break signal is generated by the Schmitt trigger 528. On the other hand, if an end out or break condition is detected in the strand 20, either a greater or a lesser amount of light is conducted back to the detector 64 by the fiber optic lead 65 depending upon whether the fiber optic lead is detecting reflected light from the running strand or whether the running strand is normally used for blocking the light to the lead 65. In either event, the light conducted back to the detector 64 when a break or end out condition is detected is relatively constant and causes the detector 64 to output a constant voltage on lead 500. With a constant voltage on lead 500, capacitor 510 serves as a blocking capacitor since the signal appears as a DC voltage and this turns off the transistor 514 or maintains it in a non-conductive state to permit the capacitor 522 to charge up. Resistor 524 is used for stability and diode 526 is used to increase a signal to the base of the transistor 514 to set the threshold or turn on level of the transistor 514 at a relatively low signal level so that in the normal case, when the strand 20 is running, even a small variable signal is able to turn transistor 514 on to prevent the charging of the capacitor 522. However, with transistor 514 turned off in response to a detected break in the strand 20, capacitor 522 charges up to a predetermined level, such as three volts, and causes the Schmitt trigger device 528 to turn on hard and output a high signal, such as plus 5 V or the like on lead 540 to indicate a detected break or end out condition.

Circuit 10C shows a 110 volt AC source signal, such as that produced by the Doff or limit switch 136 including that the product package is complete, as previously described with respect to FIG. 4. The two input terminals of circuit 10C are connected in a series current path through a conventional relay 556 and a relay 556 controls the operation of a pair of normally-open relay-operated contacts 558 as indicated by the dashed line therebetween. One of the pair of normally-open contacts is connected through a resistor to a supply node 561. Node 561 is connected directly to a plus 5 V source of potential and simultaneously to the anode of an LED 562 whose cathode is connected back to said one contact of the pair of contacts 558 which supplies the output signal on lead 568 to a first input of the I/O module circuitry of block 88 while the opposite one of the contacts 558 is connected directly to ground and supplies a second input to the I/O circuitry of block 88 via lead 570.

When an appropriate switch or the like associated with the particular circuit illustrated in circuit 10C, which is understood to be representative of any number of such circuits as required, the 110 volt input signal applied to the two input terminals energizes the relay 556 which in turn closes the contacts 558 to provide a conductive path between the plus 5 V source of potential at node 561 and ground through the parallel combination of resistor 560 and LED 562 and the closed contacts 558. With current flowing through the light emitting diode 562, it is rendered conductive to emit radiation which can be used as an indicator signal or the like indicative of the switch operation which caused the initial energization of the relay 556. Simultaneously, the closure of contacts 558 provides a discharge path for the capacitor 564 to discharge any charge accumulated during the time the contacts 558 were opened. Conversely, whenever there is no 110 volt signal at the two input terminals, relay 556 remains de-energized and the normally-open contacts 558 provide an open circuit so that the charging current from the plus 5 V source of potential at node 561 will supply charging current via resistor 560 and cause capacitor 564 to charge up to a level sufficient to maintain the LED 562 in a non-conducting or off condition, as known in the art. Capacitor 566 acts as a bounce filter for noise suppression purposes, as known in the art. Once again, the structure of circuit 10C is similar to the structure of circuit 10A except for the method of grounding the plus 5 V source of potential to permit the discharging of capacitor 564.

Circuit 10D illustrates an output signal interface circuit for command signals received from the microprocessor 70 through the I/O module circuitry of block 88. A positive output from the I/O module circuitry of block 88 is supplied via lead 572 to one plate of a capacitor 574 and to the anode of an LED 576 while the negative output is supplied via lead 578 to the opposite plate of capacitor 574 and to the cathode of LED 576. The box represented by the reference numeral 580 represents a conventional, commercially available solid state relay device such as those often used for optical isolation purposes. The normally open contacts 582 of block 580 are controlled by the operation of the LED 576, as known in the art. One of the pair of contacts 582 is connected to a 110 volt lead 584 while the opposite one of the contacts 582 is connected to the positive input of a solenoid 586, also designated SL1A, whose negative terminal is connected to the 110 volt AC lead 588.

The anode of LED 576 normally receives a high plus 5 V signal from the I/O module circuitry of blocks 88 via lead 572. Under normal conditions, a similar high signal is outputted via lead 578 to indicate that the microprocessor 70 has not commanded the particular operation requiring the energization of solenoid 586. With the high signal at both the inputs 572 and 578, LED 576 is normally maintained in a non-conductive state which holds the associated contacts 582 in a normally-open condition to prevent the flow of current through the solenoid 586. Capacitor 574 is connected in parallel with the LED 576 and acts as a filter capacitor to the signal appearing across the input leads 572 and 578, as known in the art. Whenever a low or zero voltage signal is supplied from the microprocessor 70 via the I/O circuitry of block 88 and outputted on lead 578, a 5 volt difference is caused to appear across the LED 576 turning it on and enabling it to close the contacts 582 to complete a circuit path and allow the 110 V AC power source to supply energizing current via lead 584, the closed contacts 582, the solenoid 586 and the lead 588 for energizing the solenoid 586 in response to the low command signal from the microprocessor for performing a particular function, for example, for deflating or inflating the mandrel carrying the collet 28 of FIG. 1 whenever the product package 30 is complete and the microprocessor 70 sends the low command in response to the receipt of a Doff Complete signal to command the relay controlled deflation of the mandrel and permit removal of the package. It will be realized, of course, that a similar companion circuit may be provided for receiving another command from the microprocessor 70 causing the energization of the similar solenoid to inflate the mandrel to firmly hold the collet as a new product package is begun.

Circuit 10E shows a circuit for controlling a solenoid SL7, identified by reference numeral 590, which may be, for example, a strand insertion solenoid or the like. For the operation of the strand insertion solenoid, there would be three such circuits for each side 12, 14 of the creel assembly 16 in the preferred embodiment of the present invention. When the microprocessor 70 receives the signal from one of the "end out" transducers 64 indicating the detection of a break or run down condition in the operating strand 20 and when the "prep" button 52, 54 or 56 has been manually pushed by the operator, as previously described, then the microprocessor 70 outputs an "insertion command" signal for automatically inserting an operator-prepared standby strand via the solenoid 590. As previously described, the actual insertion of the operator-prepared standby strand into the group of operating strands 20 previously being gathered and wound is accomplished by the energization of a solenoid 590 associated with the appropriate insertion device 33, 34 or 35. Since the structure and operation of circuits 10D and 10E are similar, similar elements bear similar designations (except that the referenced numerals of circuit 10E are primed), and that neither the structure nor the operation thereof will be described further herein since it is obvious to one of ordinary skill in the art.

Circuit 10F indicates yet another similar circuit which may be used to control the energization of a solenoid SL8, indicated by reference numeral 592, such as may be used for controlling the strand tension and the tension control device 42 of FIG. 1. As with circuit 10E, the structure and operation of the circuit will now be further described since it is substantially identical as that described above and obvious to one of ordinary skill in the art. It will be understood that the circuitry of circuits 10D, 10E and 10F are meant to be illustrative of any number of circuits for controlling, under computer command, the operation of any of the number of devices powered by a 110 volt source. It will be recalled from the description of FIG. 4 that the winder motor control circuitry included a solid state relay contact 126 which was under microprocessor control. It is for such devices that circuit 10F was designed, i.e., for controlling the operation of solid state relay contacts 132 and the like but it will be realized that any number of similar devices can be controlled, under microprocessor command, as would be obvious to one or ordinary skill in the art given the above descriptions.

The microprocessor-controlled roving process of the present invention utiizes an interrupt signal generated every one-tenth of a second to enable the interrupt-driven microprocessor 70 to monitor the various inputs and outputs of the high speed creel and winder assembly 10 of the present invention. The generation of these precision interrupt request signals every one-tenth of a second is described with respect to the circuitry of the timer module of block 92 of FIG. 3 detailed in the circuit of FIG. 11. The circuit of FIG. 11 includes an input lead 600 from an independent, externally-located source of 8 volt, 60 Hz AC power. Lead 600 is connected to one plate of a capacitor 606 whose opposite plate is connected to a node 604 through a series resistor 608. Node 604 is connected to the anode of a diode whose cathode is connected to a plus 5 V source of potential; is connected to ground through a capacitor 612; in parallel with diode 602 and is connected to the "up count" input of a conventional up-counter 614, such as a Motorola MC 14566. The output of the up-counter 614 is connected via circuit path or lead 616 to the CA1 input of a Peripheral Interface Adapter (PIA) 618, such as the conventional PIA 6820 previously described herein and in the previously incorporated Motorola manual. The "B" channel interrupt request flag out put of the PIA 618 is connected via lead 620 to supply the signal IRQB to both the initial interrupt Request input IRQ of an Asynchronous Communication Interface Adapter (ACIA) 622 and to the Interrupt Request Input Port IRQ of a conventional M6800 microprocessor 70 via data bus 72 of FIG. 3, as known in the art. The bus connections or data transfer paths 624 enable the microprocessor 70 to communicate with the PIA 618 and the ACIA 622 via the data bus 72, as known in the art.

A 60 cycle, 8 V signal is independently supplied via lead 600 from an external power source, as previously described, and is fed to a filter circuit comprising capacitor 606, resistor 608, and diodes 602 and 610 to the input of an up-counter 614. Capacitor 612 provides isolation and noise suppression. The counter 614 counts up and provides a sequence of precision output timing signals via lead 616 which are generated each and every one-tenth of a second. These signals are fed via lead 616 to the CA1 input of a conventional PIA 618. The CA1 input of the PIA 618 is a programmable input which provides an interrupt request flag IRQB which is outputted on lead 620 and supplied to the Interrupt Request Input (IRQ) of ACIA 622 and to the data bus 72 which provides the actual Interrupt Request Signal to the M6800 microprocessor to be used to control the programming and scanning sequences of the system 10. The ACIA 622 provides a means of efficiently interfacing the microprocessor 70 to external devices which require an asynchronous serial data format, such as a conventional teletype, CRT terminal, or the like. The data paths designated 624 between the PIA 618, the ACIA 622 and the data bus 72 forms no part of the present invention but may be used to control timed peripheral devices which may be desired or required in future or expanded applications of the present system.

BRIEF OPERATIONAL SUMMARY

Before detailing the microprocessor-controlled operation of the present system by means of the flow charts of the various sections of FIG. 9, an explanation is in order as to what is actually being controlled in the roving process of the present invention. The two major operational functions controlled by the microprocessor system are (1) strand insertion and (2) winder speed.

Strand insertion control is briefly summarized as follows. When a break or "end out" condition occurs in one of the strands 20 being delivered by a corresponding strand-serving package 18 of FIGS. 1 and 2, there is an automatic insertion of a new strand from one of the previously-prepared standby strands, and an "end needs prep" signal is automatically displayed on the control panel of FIG. 8. The operator observes this display and prepared a replacement standby package by manually threading its strand 20 through its associated strand guide 32 and to the end of the row where it is placed in a "standby" state of readiness at the corresponding stand insertion device 33, 34 or 35. The operator next presses the button 51 to indicate that one additional standby strand is now available for automatic insertion, and the depression of the button 52 turns off the "end needs prep" indicator light on the control panel of FIG. 8. When two breaks occur in the operating strands 20, the control system of the present invention automatically inserts two previously-prepared standby strands into the system and two "end needs prep" lights are illuminated on the control panel to inform the operator that two of the previoulsy-prepared standby strands have been used up. The operator responds by physically preparing two replacement standby strands, as indicated above and when the two newly-prepared standby strands are available for insertion, the operator will press a corresponding first and second reset button 52, 54 to turn off the two "end needs prep" indicator lights thereby indicating that the two previously prepared standby strands which were used up have now been replaced and normal system operation has been restored. When three breaks occur in the system, the same process is repeated regarding the automatic insertion and "end needs prep" indications and similarly, when the operator has replaced all three of the used up standby strands with three new standby strands and they are available for insertion, the operator depresses the corresponding reset buttons 52, 54, and 56 to turn off the "end needs prep" indicator lights and again indicate normal system operation. The system will continue functioning as long as at least one operator-prepared standby strand is available for insertion when a break occurs but will shut down when there is no standby strand available when a break occurs so that automatic insertion to correct the break and restore normal operation is impossible.

The foregoing description is used in conjunction with a roving process wherein each creel side contains three rows of eight each serving packages 18. The prep reset push buttons 52, 54 and 56 and their associated "end needs prep" indicator lights on the creel displaying control panel of FIG. 8 provides sufficient information for informing the operator of a need for preparing additional standby packages by screening an individual strand 20 therefrom through its corresponding strand insertion guide 32 and over to the end of the row 22, 24 or 26 to the appropriate automatic strand insertion device 33, 34 or 35 which, under microprocessor command, will automatically insert the required number of standby strands into the group of operating strands actually being wound in the roving process. Each strand-serving package 18 has associated with it a light emitting diode for monitoring the status of its associated operating strand being unwound therefrom to give a visual indication as to the status of the operating strand 20 being unwound and having delivered from its associated strand-serving package 18. This indication (which is preferably visual in nature) may be used for trouble shooting purposes or for simply informing an operator, by a visual check of the panel, of the condition or status of each running or broken operating strand by detecting the presence or absence thereof as previously described.

Since the only means for informing the microprocessor that a standby strand has been prepared by the operator and made available for automatic insertion are the prep complete or reset push buttons 52, 54 and 56, it follows that, in the preferred embodiment of the present invention described herein, if more than three strands are broken, the system will automatically shut down or stop as the microprocessor has no way of knowing whether or not more than three standby strands have been prepared and made available for insertion.

The second major operational function controlled by the present microprocessor-based system is winder speed or, alternatively, the speed of the winder motor. The winder speed control of the present invention is briefly summarized as follows. At initial start-up, the speed of the winder is controlled by a sloped ramp reference which will limit the rate of acceleration at start-up to a value less than that which would normally occur and result in damage due to a rapid pulling of the strands 20 causing breakage, etc. In other words, when a new package is just beginning to be wound, each of the operating strands 20 must be pulled to unwind or unreel it from its associated serving package 18 and the speed of pulling at the beginning of the operation of forming a particular product package must not be the same as the final speed of the winder when the particular product package is nearly formed since the inertia created by the sudden start would probably break one or more of the operating strands 20 being unwound from the serving packages 18 and could possibly damage various system equipment. The actual winder speed is measured by a tachometer which supplies speed-indicative pulses to the microprocessor for measuring the linear speed of collection of the roving materials. Any deviation between the actual measured winder speed from the pre-programmed reference speed function is detected by the microprocessor as a deviation signal which may be used to bring the actual speed closer to the pre-programmed reference speed by generating speed control signals for controlling the time or point in the AC wave form of firing the silicon controlled rectifiers to selectively vary the drive current in the armature circuit, as previously discussed in conjunction with FIG. 5 wherein the winder motor speed control circuitry is disclosed.

This technique provides a means for controlling the high rate of acceleration which the winder is capable of attaining and in so doing limits the continuity of pull of the total number of strands in the creel system. It is, of course, desirable to bring the winder up to maximum operational speed as soon as possible since the efficiency of this system depends upon the speed at which the product packages are formed, but, this must be weighed against time loss if the initial acceleration is too high causing strand breakage and equipment damage. Additionally, after initial start-up, when the winder is running at its desired stable operating speed, which is usually a function of the number and type of operating strands actually being wound to form a particular desired product package, if the deviation between the actual measured speed and the programmed speed for that corresponding number of strands occurs and is more that a predetermined amount, then the winder motor is stopped to shut down the creel operation because any such deviation represents the anticipation of a significant malfunction and requires immediate attention.

As presently embodied, when the roving package attains a certain size (measured either in terms of diameter or in terms of weight), a pack limit switch is operated and a "DOFF COMPLETE" signal generated to indicate that a product package has reached its predetermined desired size and should be removed from the system so that a new product package can be started. Alternatively, the microprocessor could be programmed to form a particular desired product package whose size is measured in terms of the length of the roving wound in each package. In this case, the length could be monitored by the microprocessor as by counting pulses provided by a transducer keyed to measure some indicia of the length of the roving being wound rather than the speed at which the winder or collet is turning, as known in the art.

The only actions required by an operator in the microprocessor-based control system of this invention is the initial setting up of a new product package to be formed, the removal of a completed product package after the microprocessor has sent a signal to enable a solenoid to deflete the mandrel and release the collet upon which the completed product package was formed, the preparation of standby strands for automatic insertion, and the operation of the push buttons to indicate any such standby strand preparation.

MICROPROCESSOR-CONTROLLED OPERATIONS

FIGS. 12.1 through 12.8 illustrate an operational flow chart or flow diagram describing the sequence of operation of the M6800 microprocessor as it goes through the process of interrogating the ongoing roving operation, monitors the status of its various sensors, and controls automatic strand insertion and the speed of the winder motor.

Figure 11:
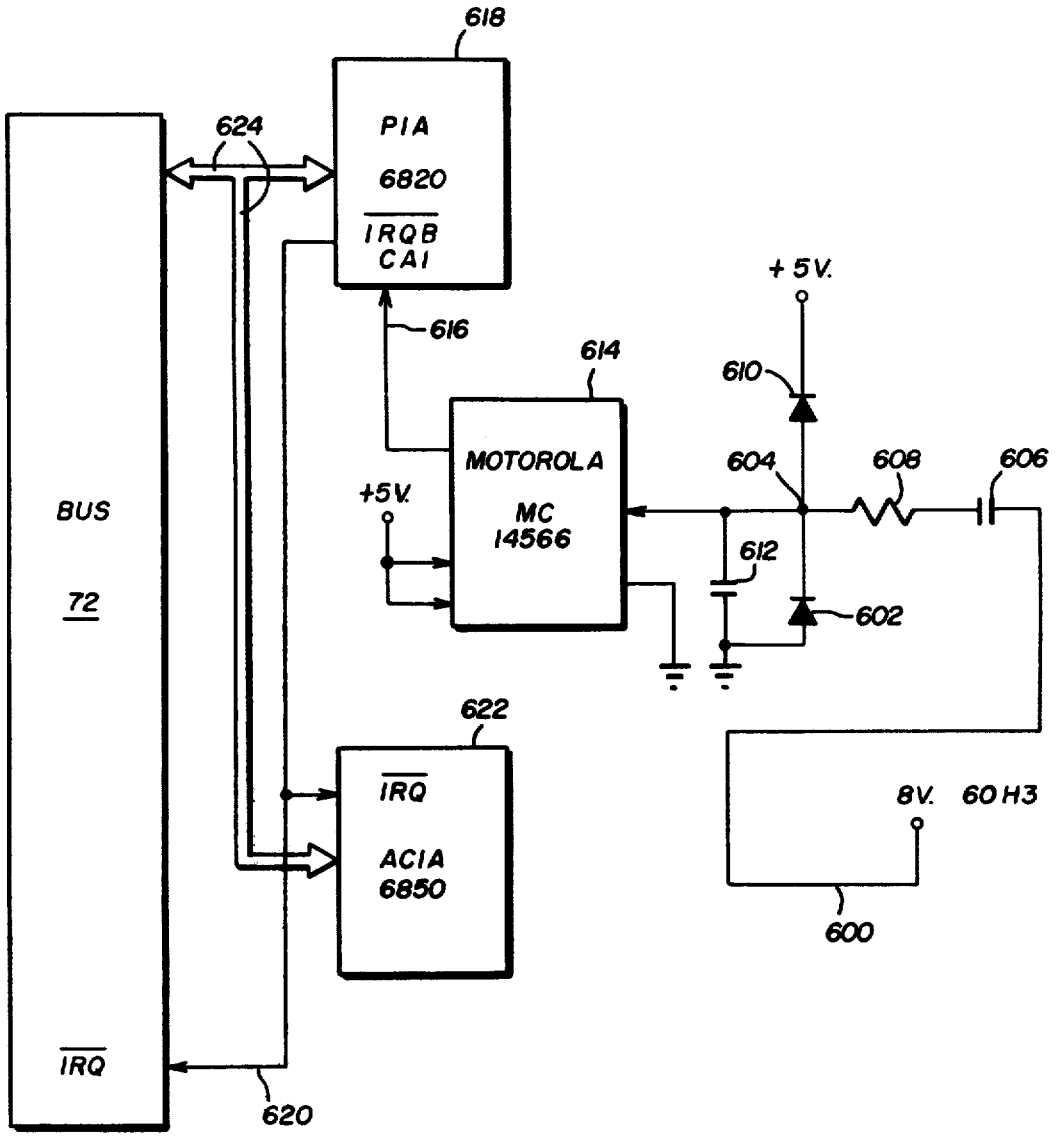
FIG. 11 illustrates, partially in schematic form and partially in block form, the timer module of block 92 of FIG. 3 for generating the periodic sequence of computer initiating interrupt signals which are generated every one-tenth of a second in the preferred embodiment of the present invention.

FIG. 12.1 starts from the initial microprocessor power-on condition and illustrates the initialization of the variables in the random access memory (RAM) and the programming of all input-output hardware, such as the input-output modules of block 88 of FIG. 4, the SCR control input-output modules of FIG. 6, and the timer module of FIG. 11. After the system initialization period, the microprocessor waits for an interrupt signal which is generated, in the preferred embodiment of the present invention, once every one-tenth of a second, as previously described.

FIG. 12.2 illustrates the overall operation of the control system of the present invention. The generation of the sequence of periodic interrupt signals once every one-tenth of a second triggers or begins the scanning and control sequence illustrated in the flow diagram shown. Once the interrupt signal occurs, the flow chart of FIG. 12.2 indicates that the program will first enable the microprocessor to read the tachometer inputs for both of the winders of sides 12, 14. These tachometer pulses, as previously discussed, are entered through the speed control interface circuitry of FIG. 7 and the SCR control I/O modules of FIG. 6 to the data bus. Next, the microprocessor reads all inputs and outputs for the first creel side 12 at which time the microprocessor begins the subroutine labeled "CREEL" which will be described with respect to the flow chart of FIGS. 12.3 through 12.8. After completion of the CREEL subroutine, the microprocessor controls the first creel side 12 and then proceeds immediately to read the inputs and ouputs of the second creel side 14. The microprocessor then executes the above-described CREEL subroutine again for the second creel side 14 and at the completion thereof, it controls the second creel side 14 operations, as previously described. When both the first and second creel sides 12, 14 are processed, the microprocessor returns to a state in which it waits for the next interrupt signal and upon receipt of the next interrupt signal, begins the entire routine outlined by the flow diagram of FIG. 12.2 anew.

At this point, it should be noted that the following discussion of the the CREEL subroutine will be discussed for purposes of simplicity without regard to which the creel sides 12 or 14 is currently being processed. However, for the purpose of accuracy, it should be noted that the various exits from the program depicted by the flow charts of FIGS. 12.2 through 12.8 which are indicated as exiting programmed to node "A" which normally refers to the microprocessor waiting for the next interrupt, as shown in FIG. 12.1, will multiply when the first creel side 12 is itself the side being processed. That is, when the first creel side 12 is being processed and the program shows an exit to "A" indicating a wait for the next interrupt, the microprocessor first goes and performs all operations for the second creel side 14 by replacing the same CREEL subroutine for the second creel side 14 and performing the required control operations therefore before exiting to "A" to await the arrival of the next interrupt signal. In this case, the flow chart indication of an exit to "A" does indeed cause the program to go back to the "A" node or entry point indicated on the flow chart of FIG. 12.1 before it begins processing the first creel side 12 while this was not true before. The microprocessor completes the CREEL subroutine for both creel sides 12, 14 between subsequent interrupt signals, that is, it completes the entire CREEL subroutines for both sides 12 and 14 during each one-tenth of a second time interval between interrupts so that the entire roving system including both winders and both creels is monitored and controlled each and every one-tenth of a second for continually updating the system during normal operation. It should also be noted, for ease of description, that the creel side 12 and creel side 14 are referred to in the flow diagrams of FIG. 9 as creel side A and creel side B, respectively.

The CREEL subroutine begins, as indicated in the flow diagram of FIG. 12.3, by the program selecting which of the creel sides 12, 14 is to be processed and initially asks if a data entry is in progress. If a data entry is in progress, it would indicate that either data and/or functional information for a new product package is about to be or is currently being entered into the system. If a data entry is in progress, then the microprocessor asks if a valid function or function code exists before the new data is entered since it is the function code which tells the microprocessor where to store the new data being entered. The answers to certain of the inquiries set forth in the flow chart of FIG. 12.3 determine whether newly entered data is to be stored for the next product package to be wound or whether the microprocessor is to continue to display the current data on the control panel. If a valid function exists, the newly entered data is stored but if the answer to any of these inquiries is no, the microprocessor knows that no new data is to be entered and so it skips ahead to ask if a display of the data previously entered on the thumb wheel switch is requested. If so, it then isolates the function requested and displays the four digits of data previously entered on the display panel. If no display is requested or, in any event, after the display request entry, the next significant control question in the program is used to determine if a data change is in progress when a winder start is being attempted.

If the data is being changed when an attempt is made to start the winder, the program proceeds directly to or exits to "B" which in turn re-enters the program in the flow chart of FIG. 12.7 to check the product codes status. If a bad product code is recognized, the microprocessor goes to the next product code question and if such a new product code is not in the product table, it sets a bad product code indicator and turns on the change in progess light which, in turn, sets the data change in progress on start up indicator and goes back to wait for the next interrupt to begin the routine anew via the exit to "A".

Again, it should be recognized that we are talking only about the first side 12 or side "A" of the creel so when the CREEL program exits to "A" after the set data change in progress on start-up is complete, as shown in the flow diagram of FIG. 12.7, the microprocessor will immediately return, as indicated in FIG. 12.2 to creel side 1 or side "B" to begin the CREEL subroutine with respect thereto. But the CREEL routine shown as starting in the flow diagram of FIG. 12.3 is entered and begun for the second creel side 14 so that if the set data change in progress on start-up inquiry of the flow diagram of FIG. 12.7 refers to the second side 14, the exit to "A" will indeed go to the appropriate labeled entry point or "A" node in the flow diagram of FIG. 12.1 and await the next clock interrupt signal upon receipt of the next clock interrupt signal, the entire program routine illustrated by the flow diagram of FIG. 12.2 will again be run.

If, in the flow diagram of FIG. 12.7, the microprocessor receives no bad product code indication, the program would ask if a change is in progress. If no change is in progress, the program would turn off the change in progress light, set the required product tension desired and then exit to "A" as previously described. Lastly, if no bad product code was detected and a change in progress was in progress, the microprocessor will proceed to immediately turn on the change in progress light, set the data change in progress on start up indication and then exit to "A" in accordance with the program steps illustrated in the flow diagram of FIG. 12.7.

Again referring back to the flow diagram of FIG. 12.3, when the microprocessor asks if a data change is in progress when a winder start is being attempted and the answer to that question is no, the program goes on to calculate the speed error before exiting to node "L". Node "L" indicates a reentry into the CREEL subroutine as indicated at the top of the flow diagram of FIG. 12.4. The first inquiry made in the flow diagram of FIG. 12.4 relates to the start-up set point ramp of the input speed function which is queried as to its completion and is then followed by an inquiry concerning the completion of the final set point ramp speed. It should be remembered that when the data concerning the speed function is entered on the rotary switches of the control panel for a particular product to be formed by the roving process (usually computed as a function of the number and type of operating strands required to be wound to form the product), the initial start-up of the creel system is made by turning on the winder motor which is driven by the initial ramp signal to avoid damage to the serving packages, strand breakage, and the like which could occur if the initial acceleration is too high. Therefore, the common method of entering a function code to begin the start-up and then monitoring the start-up of the motor is to first enter an initial ramp reference which starts at a velocity of zero and gradually increases in a ramp-like manner until a final ramp set speed point is reached.

As a compromise between a very long but slow start up period and an acceleration whose magnitude is unacceptable since it may result in strand breakage or damage to the serving packages, a two-ramp start-up is used in the preferred embodiment of the present invention wherein a first steep ramp initially accelerates the winder speed quickly from zero to a first predetermined speed level and then the second ramp allows the winder to more slowly accelerate the winder speed under control of the microprocessor speed control system previously described until the final ramp set point or second predetermined winder speed is attained. It is to these two distinct ramp references that the microprocessor must refer in making its speed control computations. Once the system has determined that the second predetermined winder speed is attained, which corresponds to the normal desired operating speed for the particular program product being wound, it may proceed to process the tachometer inputs and compute the actual current winder speed in order to determine the speed error and hence the amount of correction required to adjust the speed of the winder motor to track or maintain the pre-programmed stored desired speed function required for forming a particular product package. As previously discussed, the SCR control I/O module circuitry of FIG. 6 responds to the incoming tachometer signals and outputs pulses for firing the SCRs of the circuit of FIG. 5 at the desired point in the AC wave form to selectively control the power input driving the armature of the winder motor and therefore the winding speed.

The purpose of the "Calculate Output for Speed Control" step in the flow chart of FIG. 12.4 is to produce the required number which is to be entered into the PIA of the SCR control input output module circuitry of FIG. 6. This calculation involves complex integrations and proportioning steps which are accomplished by the microprocessor and the output speed signal is queried as to whether it exceeds a first predetermined speed error limit which, in the preferred embodiment of the present invention, is thirty feet per minute. If that first speed error limit is exceeded, the microprocessor will, after checking for the completion of the delay built into the system to determine whether the speed error is only temporary, stop the winder motor and turn on a speed error light on the control panel. When this occurs, a program exits to "F" and reenters the flow diagram of FIG. 12.6 at node "F" to start the system again or, if not, to exit to "A" and go back and wait for the next clock interrupt signal, as previously described.

If the calculated speed error does not exceed the first speed error limit, the next question asked is whether a strand insertion has been requested and if it has and if a start-up delay has elapsed or is completed, the microprocessor proceeds to exit to "D" and reenter the subroutine at a correspondingly labeled entry node "D" of the flow chart of FIG. 12.5 to query the system as to whether a strand has just been inserted and whether a delay has been completed to permit a start-up of the winder motor. If the answers to these questions is yes, the number of ends running (operating strands being wound) are counted and compared to the desired number requested and required for forming a particular product package selected. If any of the start-up delays have not been completed, the microprocessor assumes that the counted number of ends running compares equally to the desired number requested and proceeds to exit the program to "C" which reenters the subroutine at the "C" input node of the flow diagram of FIG. 12.5 to immediately check to determine if a standby strand has been prepared by the operator in order to determine whether additional standby strands need to be prepared. Once the operator has prepared the required number of standby strands for insertion and depressed the appropriate prep complete button to indicate same to the computer, it turns off the "end needs prep" light on the displaypanel. Lastly, the microprocessor checks to see if a start up delay has elapsed and, as indicated above, exists to "M" if it has and to "A" if it has not.

If, in the flow chart of FIG. 12.4, a strand insertion is not requested, the microprocessor exits to "G" to the start-up delay complete question of the flow diagram of FIG. 12.5 as described hereinabove. The exit to "M" reenters the subroutine as indicated at the top of the flow diagram of FIG. 12.6 and asks whether the winder is running. If the winder is not running, the program exits to "E" which reenters the subroutine in the flow diagram of FIG. 12.8, but if the winder is running, the program seeks to determine the DOFF COMPLETE status. If the DOFF is not yet completed, the program exits to "A" to await the next interrupt signal but if a DOFF COMPLETE condition exists, the microprocessor stops the winder; turns on the "DOFF COMPLETE" indicator light; and then asks if the winder is still turning. If the winder is still turning, the program exits to "A" but if it is not still turning, the mandrel is deflated and the program asks if a winder start button has been pushed. If not, the program exists to "A" but if so, the microprocessor turns on the relay to start the winder motor; turns off the error light on the panel; and sets a time delay for strand counting and motor running. The program then asks if a new product package is being started and if it is not, the old parameters which were saved and stored when the winding motor stopped running are reloaded and an exit is made to "A". If, however, a new package is being started, the program exits to "K" only to reenter a program as indicated at the top of the flow diagram of FIG. 12.7.

Referring back to the flow diagram of FIG. 12.5, the program asks if the counted number of ends actually running matches the desired number of ends requested, and if it does not, the flow diagram continues to ask whether too many ends are running. A negative answer to that question indicates that there are not enough ends running and the program asks if the three-tenths second delay has elapsed before exiting "C" if it is not, and eventually going back to wait for an interrupt by exiting to "A" as previously described. If the three-tenths second delay is complete, the system asks whether a standby strand has been prepared for insertion and if there is no standby strand available for insertion, the winder is stopped and the end error light is turned on. If, however, a standby strand is available for insertion, the microprocessor commands the insertion of the standby strand and turns on the "end needs prep" light to tell the operator that he may now prepare a replacement strand for standby purposes. When the "end needs prep" light is turned on, the program again exits to "C" for reentering the flow diagram of FIG. 12.5 to ask whether a standby strand has been prepared by the operator and so on, as previously described hereinabove.

If too many strands are running, a twenty-six second delay period is begun. During each subsequent one-tenth of a second cycle, the program asks if too many ends are running during the twenty-six second delay period and reexits to "C" if there are. Finally, the program will ask if the twenty-six second delay period is completed (while too many strands are running) and the answer will be yes so that the microprocessor can command the winder motor to stop and turn on the "end error" indicator light on the control panel. The 26 second delay is used to allow the operator time to adjust the number of remaining strands to those required for the new product by removing any excess strands not required.

As previously discussed, it can be seen that the microprocessor will insert additional operator-prepared standby strands if there are any such standby strands prepared and available for insertion. Therefore, if the difference between the actually counted number of operating strands which are running and the desired number of strands requested for forming a particular product package exceeds three (the maximum number of standby strands available for insertion in the preferred embodiment of the present invention), and it is not possible to say yes to the question (Has a standby strand been prepared for insertion by the operator?) the program will stop the winder and the "end error" indicator light will be turned on since it is not possible for the system to continue running since there are not enough of available operating strands for forming the desired product package.

The flow diagram of FIG. 12.6 is entered at entry node "M" and first asks if the winder is running. If it is not running, the program exits to "E" but if it is running, it then proceeds to ask if the DOFF is complete, which means that the pack limit switch on the creel has been turned on. If it is not complete, the program exits to "A", but if it is complete, then the microprocessor stops the winder, turns on the "DOFF COMPLETE" indicator light on the display panel, and then tests to see if the winder is still turning. The test of the winder is necessary as the microprocessor system operates in tenths of a second for each inquiry, whereas the motor of the winder is not able to stop in that time frame. It will be recalled that the winder motor control circuit of FIG. 5 employs a dynamic braking in the power circuit to the armature which, although effective, requires a substantial amount of time to completely stop the winding operation. When the winder has fully stopped, the microprocessor outputs a command to deflate the mandrel. At this point, the creel and winder of the side 12 or 14 under consideration, are completely stopped and will not start again until a winder start button is manually pushed after the operator has removed the completed product package and begun a new one. The program exits to "A" until the pushing of the winder start button by the operator, either on the motor control panel or on the creel control panel, and then a relay is energized to start the winder motor; the error light is turned off; and the delays for strand counting and motor running are set. If a new product package is not being started, the data stored and saved when the motor was stopped is reloaded; the DOFF light is turned off; and the program exits to "A", as previously described.

However, if a new package is being started, the flow chart exits to "K" and reenters the CREEL subroutine at the "K" entry node located at the top of the flow diagram of FIG. 12.7 which sets the start-up parameters; inflates the mandrel; queries the product code; checks whether the product code is good or bad; and if good, enters the new product data into the appropriate control area and the memory of the microprocessor. At this point, the microprocessor also checks to see if there is new data entered to modify the previously entered product code and integrates the new data with the old data already stored in its memory for a particular product package. This is accomplished operationally by the function switch and the data entry switch assemblies on the creel display and control panels 402, 402[1], previously described and is entered through the creel control data entry circuits FIG. 10 and the I/O circuitry of block 88.

The program then locks for a bad product code and a positive indication of such indicates to the microprocessor that inputs from the control panel were not properly programmed so as to prevent someone from setting and entering an improper product code either by mistake or by accident. If a bad product code is detected, the subroutine returns to the new product code inquiry. If no new product code has been entered, the product table inquiry will indicate that no such code is in the table; set a bad product code indicator; turn on the "change in progress" light; set the "data change in progress on winder starting" on start-up indicator; and exit to "A". If no bad product code is detected and a change in progress is detected, the "change in progress" light is turned on; the "data change in progress on winder starting" indicator is set; and the routine again exits to "A", as previously described. Lastly, if no bad product code is detected and no change is in progress, the microprocessor will turn off the "change in progress" light; set the product tension required; and exit to "A".

One further note with respect to the flow diagram of FIG. 12.7 which is of interest relates to the microprocessor commands for setting the particular strand tension required for the new product package to be produced after the "change in progress" light has been turned off. The data entered on the creel displaying control panel addresses the computer's memory to allow the microprocessor to control the amount of product tension necessary for that particular product code. The selection of a particular product tension allows the microprocessor to compute commands for controlling the energization of one, two, or three solenoids which may be used to increase and decrease strand tension in the corresponding groups of operating strands which are gathered or collected to form a roving actually being wound on the collet, as known in the art.

The flow chart shown in FIG. 12.8 is entered at entry node "E" and used to illustrate a cycle to be completed by the program when the winder is found not to be running from the inquiry of the flow diagram of FIG. 12.6. In other words, if the winder is not running at this point, the microprocessor asks a series of questions concerning the reason for its not running. The microprocessor queries the DOFF COMPLETE, the end error, the speed error, and the operation stop statuses to determine the cause for the winder not running. If the DOFF is completed, the microprocessor exits to "A" to reenter the program in the flow diagram of FIG. 12. If there is an end error, a speed erro, or an operation stop indication, then the program exits to "F" to reenter the program in the designated "F" entry node in the flow diagram of FIG. 12.6 to wait for the winder start button to be pushed, as indicated above. If none of these reasons are the cause of the winder being stopped, indicating that the cause of the problem has not been located, the microprocessor turns on an "operation stopped" indicator light and generates its own "stop the winder" indication and then the program exits to "F" to reenter the program at the designated "F" entry node in the flow diagram of FIG. 12.6 as previously described. The "operation stopped" light is a troubleshooting light not normally displayed on either the winder panel or the creel display and control panel previously described.

With this detailed description of this specific apparatus and program used to illustrate the preferred embodiment of the present invention and the operation thereof, it will be obvious to those skilled in the art that various modifications can be made in both the method and apparatus of the present invention without departing from the spirit and scope of the invention which is limited only by the appended claims.

We claim:

1. A method of controlling strand insertion in a high speed creel assembly used in a roving process, said method comprising the steps of: sensing the operating strands actually being wound in the roving process, comparing the sensed strands actually being wound with the desired strands required for forming a particular product package, indicating whether a prepared standby strand must be added to said operating strands actually being wound to provide said desired strands and inserting said standby strand as required.

2. The method of claim 1 further including the step of shutting down said roving process whenever the prepared standby strands which must be inserted are not available.

3. A method for controlling strand insertion in a high speed creel assembly used in a roving process wherein the creel assembly includes a plurality of strand serving means, a first indication representing a preprogrammed desired number of strands which are required to be wound together in a group onto a collet to form a particular product package and a second indication representing standby strands prepared for automatic insertion into said group being wound, said method comprising the steps of:

sensing the operating strands actually being wound and storing a third indication representative thereof;

inserting one of said second indicated prepared strands into said group being wound as long as said first indication exceeds said third indication by a value no greater than the value of said second indication.

4. The method of claim 3 further including the step of stopping said roving process when said first indication exceeds said third indication and there are no standby strands prepared for automatic insertion.

5. A method for controlling strand insertion in a high speed creel used in a package roving process comprising the steps of:

sensing the operating strands actually being gathered together and wound on a collet;

storing a first indication representing the desired strands required to be wound on said collet for forming a particular product package;

deducting said sensed operating strands from the available strands to obtain a second indication, said available strands being equivalent to said sensed strands actually being wound on said collet and the prepared standby strands currently available for insertion into the operating strands;

inserting prepared standby strands needed to equalize said first indicator and said sensed strands whenever said first indicator is greater than said sensed strands and the excess is not greater than the second indication.

6. The method of claim 5 further comprising the step of stopping said roving process when said stored first indication is greater than said sensed strands by an amount larger than said second indication.

7. Apparatus for controlling strand insertion in a high speed creel system used in a package roving process wherein said high speed creel system includes a plurality of strand serving means, means for gathering a plurality of operating strands into a group, and motor driven winding means for winding said group of operating strands on a collet to form a product package, said insertion control comprising:

transducer means for sensing the dispensing of said operating strands from said serving means to form said group;

means for monitoring operator-prepared serving means available for inserting standby strands into said plurality of operating strands being gathered into said group to be wound on said collet;

strand insertion means for inserting said operator prepared standby strands into said plurality of operating strands being gathered into said group and wound, said strand insetion means being responsive to the strands which are required to be wound to form a particular product package and a comparison means for comparing said required strands with said sensed strands; said strand insertion means inserting one of said operator prepared standby strands into said sensed strands group until said sensed strands equal said required strands for a particular product.

8. The apparatus of claim 7 further comprising a roving process shut-down means responsive to a lack of operator prepared standby strands in response to an output from the strand insertion means, to stop said roving process.

9. Apparatus for monitoring and controlling a high speed creel system used in a package roving process wherein the creel system contains a plurality of strand-serving means for dispensing operating strands which are wound together in a group on a collet to form a product package and wherein said collet is turned by a winding motor, said control apparatus comprising (1) transducer means for sensing the presence of each operating strand; (2) counter means for counting the number of said sensed operating strands; (3) first storage means for storing a first indication equal to the desired operating strands required for forming a particular product package; (4) second storage means for storing a plurality of desired motor speed functions, each of which corresponds to a different product package; (5) third storage means for storing a second indication equal to the excess of the total available strands, with the total being equal to the sum of the operating strands actually being wound and the operator-prepared standby strands currently available for insertion into said group of operating strands, over said operating strands being currently wound; (6) means for selecting a desired motor speed function based upon said product being formed; and (7) sensing means for measuring the actual winding motor speed; (8) first comparator means for increasing and decreasing the speed of said winding motor when the difference between said actually measured winding motor speed and said stored motor speed function exceeds a predetermined value; (9) means for inserting a prepared standby strand into said plurality of operating strands actually being wound and decreasing said second indication so long as said first indication exceeds said operating strands actually being wound by a value less than or equal to the value of said second indication and for stopping said winding motor to shut down said roving process when said first indication exceeds said operating strands by a value greater than the value of said second indication.

10. A method for controlling the operation of a high speed creel system used in a package roving process wherein said creel system includes a plurality of operating strands which are wound on a collet to form a product and wherein said collet is turned by a winding motor comprising steps of: (1) sensing said operating strands actually being wound; (2) storing a first indication equal to said operating strands; (3) storing a second indication equal to the strands desired for forming a particular product; (4) storing a plurality of motor speed functions, each of said motor speed functions corresponding to a different product; (5) selecting a desired motor speed function based upon the sensed operating strands actually being wound; (6) preparing a number of standby strands available to be inserted into said operating strands actually being wound; (7) monitoring said prepared standby strands available for insertion; (8) storing a third indication of said monitored prepared standby strands available for insertion; (9) comparing said stored first and second indications; (10) measuring the actual motor winding speed; (11) comparing said measured winding motor speed to said stored desired motor speed function; (12) increasing and decreasing the speed of said winding motor when the difference between said measured winding motor speed and said stored desired motor speed function exceeds a first predetermined value; (13) inserting a prepared standby strand into said operating strands actually being wound and decreasing said third indication whenever said second indication exceeds said first indication by a value of less than or equal to the value of said third indication; (14) and stopping the roving process by turning off said winding motor whenever said second indication exceeds said first indication by a value greater than the value of said third indication.

11. The method of claim 10 further including the step of stopping said roving process by turning off said winding motor when the difference between said measured actual winding motor speed and said stored desired motor speed function exceeds a second predetermined value.

12. A high speed creel system used in a roving process and including a creel assembly, a plurality of strand serving means operatively disposed on said creel assembly for dispensing a plurality of operating strands, means for gathering said plurality of operating strands, a collet for operatively receiving said gathered operating strands and winding same thereon to form a product package, motor means for rotating said collet to effect said winding operation, means for controlling the speed of said winding motor means, means for measuring the actual speed of said winding motor means; means for sensing the actual number of dispensed operating strands being gathered to be wound on said collet, further comprising means for storing a plurality of different desired motor speeds which are a function of the particular product package being formed, said motor speed control means being responsive to the number of actual operating strands initially sensed by said sensing means for selectively determining the initial speed of said winding motor means and comparator means for measuring the difference between said measured actual motor speed and said stored desired motor speed corresponding to the product presently being wound; said motor speed control means being responsive to at least one predetermined value of said measured difference for a given number of counted operating strands for selectively increasing and decreasing the winding speed of said motor means.

13. An high speed creel system used in a roving process and having a creel assembly, a first plurality of strand serving means operatively disposed on said creel assembly for dispensing a corresponding first plurality of operating strands, means for gathering said operating strands into a group of operating strands, means for operatively winding said gathered group of operating strands on a collet to form a product package, motor means for rotating said collet to wind said group of operating strands thereon, sensing means for detecting the presence of each of said dispensed operating strands, means for counting said detected number of operating strands being dispensed from said serving means to be gathered for winding purposes, a plurality of strand serving means operatively disposed on said creel assembly and prepared for inserting a corresponding second plurality of standby strands into said dispensed operating strands being gathered in the event of a strand break, end run-out or the like, means responsive to a strand insertion signal for inserting at least one of said second plurality of prepared standby strands into said operating strands being gathered, further comprising means for storing the desired value of sensed strands required for forming a particular product package, means for monitoring said prepared standby strands currently available for insertion and storing same (an indication thereof), means for deducting said operating strands actually being gathered into said group being wound from said stored desired strands required for forming said particular product package to obtain a difference indication, means for comparing said difference indication and said stored indication representing the number of prepared standby strands currently available for insertion, means responsive to said difference indication being less than or equal to said stored indication representing the number of prepared standby strands currently available for insertion for inserting standby strands equal to the value of said difference indication, and means responsive to said difference indication being greater than said stored indication representing the number of prepared standby strands currently available for insertion for shutting down said roving process.

14. The product roving system of claim 13 further including means responsive to said standby strand monitoring means for generating an indication of such standby strands which have been inserted and not reprepared; means responsive to the preparation of each replacement serving means for making a corresponding standby strand available for insertion; and means for restarting said roving process when said difference indication again becomes less than or equal to said stored indication representing the number of prepared standby insertion strands currently available for use.

15. A method of detecting and correcting faults in a product package roving process system having a high speed creel with a plurality of serving packages each serving out a strand, said strands being collected together on a collet and wound thereon by a winding motor, comprising the steps of:

(1) sensing the operating serving packages actually supplying strands to be wound on said collet;
(2) providing a first indication equal to the desired operating strands required for forming a particular product package;
(3) detecting when said sensed serving packages are less than said first indication and providing a second indication indicative thereof;
(4) inserting a pre-prepared standby strand into said operating strands being collected and wound in response to said second indication.

16. The method of claim 15 further including the steps of detecting when no more prepared standby strands are available for insertion when said second indication is provided; generating a STOP signal indicative thereof; and shutting down said product package roving process in response to the generation of said STOP signal.

17. The method of claim 15 further including the steps of providing a third indication to indicate that one of said pre-prepared standby strands have been inserted and therefore that one of said pre-prepared standby strands has been used up and is no longer available for insertion; generating a visual indicia representative of said third indication; and preparing another standby strand for insertion in response to said visual indicia and terminating said visual indicia upon completion of said standby strand preparation.

18. The method of claim 15 wherein said second indication is a signal.

19. Apparatus for detecting and correcting faults in a product package roving process system having a high speed creel with a plurality of serving packages each serving out a strand, said strands being collected together on a collet and wound thereon by a winding motor, comprising:

sensing means for sensing the operating serving packages actually supplying strands to be wound on said collet;

indicator means for providing a first indication equal to the desired operating strands required for forming a particular product package;

detecting means for detecting when said sensed serving packages are less than said first indication and providing a second indication thereof;

insertion means for inserting a pre-prepared standby strand into said operating strands being collected and wound in response to said second indication.

20. The apparatus of claim 19 further comprising second detection means detecting when there are no more prepared standby strands available for insertion when said second indication is provided; signal generating means to provide a STOP signal; means for shutting down said product package roving process in response to the generation of said STOP signal.

21. The apparatus of claim 19 further comprising third signal generating means to indicate that one of said pre-prepared standby strands have been inserted and therefore that one of said pre-prepared standby strands has been used up and is no longer available for insertion; generating means for generating a visual indicia representative of said third indication; strand preparation means for preparing another standby strand for insertion in response to said visual indicia and terminating said visual indicia upon completion of said standby strand preparation.

22. The apparatus of claim 19 wherein said second indication is a signal.

23. An industrial roving process using at least one high speed creel system, said at least one high speed creel system including a plurality of strand-serving packages each of which is adapted to supply a fibrous strand, said plurality of strand-serving packages being banked together in a matrix formation and each of said strand-serving packages having associated therewith a strand insertion guide means through which the individual strand from said serving package is threaded and wherein each row of said matrix formation of serving packages is provided with strand insertion means for inserting said individually threaded strands into a collected group of strands, each of said creel systems including means for gathering said groups of strands from the various rows of said matrix formation of serving packages, each of said at least one creel system including a winding motor for rotatably turning a collet for gathering said collected groups of strands to form a product package, tachometer means operatively associated with said winding motor for generating tachometer pulses indicative of the actual winding speed of said motor, and transducer means operatively disposed proximate each of said individual strands being inserted via said strand insertion guide means and said insertion means to form said group of strands for generating a first signal indicative of the presence of said individual strand, further comprising:

microcomputer means having a memory means operatively associated therewith and at least one program means stored in said memory means and executable by said microcomputer means for implementing control operations;

means for operatively coupling said speed indicating tachometer pulses to said computer means for calculating the actual speed of said winding motor and storing an actual speed value indicative thereof in said memory means;

means for operatively coupling said first signals to said computer means for counting the number of operating strands actually being inserted into said groups and storing a first number indicative thereof in said memory means, said memory means also storing a second number representing the desired number of operating strands required to be wound to form a particular product package and a second set of values of motor winding speeds computed as a function of the number of operating strands currently being wound;

motor speed control means responsive to motor speed control signals from said microcomputer means for controlling the speed of said winding motor, said microcomputer means implementing said program means and utilizing the data stored in said memory means for initially generating a first speed control signal commanding said motor speed control means to initially operate said winding motor at a first speed based upon said stored first number and for computing the difference between said stored first and second values of motor speed for generating a second motor speed control signal commanding the increasing or decreasing of said winding motor speed whenever the difference between said first and second values exceeds a predetermined amount.

24. The roving process system of claim 23 wherein each of said at least one creel systems includes a third number of pre-prepared strand-serving packages of standby strands available for insertion by said strand insertion means, said microcomputer means subtracting said first stored number from said second stored number to compute a difference indicative of the number of standby strands which must be inserted to restore the first number of counted operating strands actually being wound to form said product package to equality with the second number representing the desired number of strands required for forming said particular product package, said microcomputer means generating a strand insertion command whenever said difference is less than or equal to said third number, said strand insertion means being responsive to said strand insertion command for inserting a pre-prepared standby strand.

25. The industrial roving process of claim 23 wherein said strand insertion command inserts a number of pre-prepared standby strands equal to said difference into said groups of operating strands for increasing said first number to equality with said second number while decreasing the value of said third number by the value of said difference, and said microcomputer means generating a STOP signal whenever said difference is greater than said stopped third number, said motor speed control means being responsive to said STOP signal for turning off said winding motor to shut down said roving process.

26. An industrial roving process using at least one high speed creel system, said at least one high speed creel system including a plurality of strand-serving packages each of which is wound with a signle fibrous strand, said plurality of serving packages being banked together in a matrix formation and each of said serving packages having associated therewith a strand insertion guide means through which its corresponding individual fibrous strand is guided and wherein each of the rows of said matrix formation includes a strand insertion means for inserting said individually guided operating strands into a group of operating strands, a winding motor for rotatably turning a collet for collecting and winding said groups of operating strands thereon to form a product package, tachometer means operatively associated with said winding motor for generating tachometer signals indicative of the winding speed of said motor, transducer means operatively associated with each of said individually guided strands for detecting its presence and generating a "strand present" signal indicative thereof, motor speed control means responsive to various motor speed control signals for controlling the winding motor speed said strand insertion means being responsive to a strand insertion command for controlling the operation thereof, further comprising:

microcomputer means having a memory means operatively associated therewith and a program means stored within said memory means for execution by said microcomputer means to implement at least one program sequence for controlling the strand insertion operation;

means for operatively coupling said "strand present" signals to said microcomputer means for counting the number of operating strands actually being inserted into said groups for winding on said collet, said microcomputer means storing a first number indicative of said counted number of operating strands in said memory means;

means for entering a desired number of strands required to be wound on said collet for forming a particular product package and storing a second number indicative thereof in said memory means;

said at least one creel assembly further including a plurality of prepared serving packages available to serve standby strands for insertion into said group of operating strands by said strand insertion means;

means for monitoring the status of said plurality of prepared serving packages of standby strands and for storing a third number indicative of the number of said monitored standby strands currently available for insertion into said group of operating strands in said memory means;

said microcomputer means subtracting said first number from said second number to generate a fourth number indicative of the number of standby strands which must be inserted into said gorup of operating strands in order that said desired number of operating strands required for forming said particular product package are being wound;

said microcomputer means comparing said third and fourth numbers for generating a strand insertion signal whenever said fourth number is less than or equal to said third number, said strand insertion means being responsive to said strand insertion signal for inserting a standby strand.

27. The industrial roving process of claim 26 wherein said strand insertion signal inserts a number of standby strands equal to the value of said fourth number into said group of operating strands thereby making said first number equal to said second number and decreasing said third number by the value of said fourth number for subsequent operations; said microprocessor means being further responsive to said comparison of said third and fourth numbers for generating a STOP signal whenever the value of said fourth number is greater than the value of said third number, said motor speed control means being responsive to said STOP signal for turning off said winding motor to shut down the operation of said roving process.

28. The product roving system of claim 26 further including means for entering a set of second values computed as a function of the number of operating strands being wound to form a product and storing same as a second value in said memory means, said microcomputer means utilizing said first number and the second value corresponding thereto for generating a first motor speed control signal for initially controlling the winding speed of said motor based upon the number of operating strands currently being wound said motor speed control means being responsive to said first motor speed control signal for initially driving said winding motor at said commanded initial speed;

means for operatively supplying said tachometer signals to said microcomputer means for measuring the actual speed of said winding motor and storing a first value indicative of actual measured motor winding speed in said memory means, said memory means further including a second program means for execution by said microcomputer means to implement a sequence of program steps for implementing the motor speed control operation, said microcomputer means executing said second program means to determine the difference between said first and second values and generate a second motor speed control signal whenever the computed difference exceeds a first predetermined value, said motor speed control means being responsive to said second motor speed control signal for selectively increasing and decreasing said winding motor speed from said initially established motor speed.

29. The product roving system of claim 28 further including means for entering a second predetermined difference value and storing same in said memory means, said microcomputer means executing said second program means for computing the difference between said first and second stored values and generating a third speed control signal whenever the computed difference exceeds said stored second predetermined value, said motor speed control means being responsive to said third motor speed control signal for turning off said winding motor to shut down said roving process.

30. A roving process control system for use in forming a product package using a high speed creel and winder assembly for collecting and winding a plurality of operating strands on a collet to form a product package, said assembly including a plurality of serving packages, each of which is operatively disposed on a high speed creel for dispensing an individual fiber-like strand therefrom, a winder means including a winder motor and a collet rotatably driven by said winder motor for collecting and winding said plurality of said operating strands thereon, tachometer means operatively associated with said winding motor for generating a plurality of tachometer signals indicative of said winding speed, motor speed control means responsive to one or more motor speed control signals for selectively controlling the operating speed of said winder motor, transducer means operatively associated with each of said individual operating strands being dispensed for winding purposes for generating a first signal indicative of the presence of each of said individual strands being dispensed for winding purposes, certain of said plurality of serving packages being prepared for serving standby strands available for insertion upon command into the group of operating strands being wound, means for monitoring the number of said prepared standby strands ready for insertion, insertion means responsive to a strand insertion command for inserting at least one of said prepared standby strands into said group of operating strands being collected and wound on said collet, comprising:

a microprocessor;

a memory means operatively associated with said microprocessor;

program means stored in said memory means for execution by said strand insertion operations and a second sequence of program steps for controlling winding speed operations;

means operatively coupling said tachometer signals to said microprocessor for counting same and storing a first value indicative of the actual measured speed of said winding motor in said memory means;

means for operatively coupling said first signals to said microprocessor for counting the number of individual operating strands actually being dispensed to be wound on said collet to form said product package and storing a first number indicative thereof in said memory means;

means for operatively coupling said monitoring means to said microprocessor for counting a number of prepared standby strands currently available for insertion and storing a second number indicative thereof in said memory means;

means for entering the desired number of strands required to be wound on said collet to form said particular selected product package and storing a third number indicative thereof in said memory means and for entering a set of second winding motor speed values computed as a function of the number of strands being wound and storing said second values in said memory means;

said microprocessor executing said program means to implement said first sequence of program steps for subtracting said first stored number from said third stored number to produce a fourth number indicative of the number of prepared standby strands required to be available to maintain the production of said selected particular product package, said first sequence of program steps being executed by said microprocessor to generate a strand insertion signal whenever said computed fourth number is less than or equal to said stored second number and for generating a first STOP signal whenever said computed fourth number is greater than said stored second number, said strand insertion means being responsive to said strand insertion signal for inserting a number of said prepared standby strands into said group of operating strands equal to said calculated fourth number so as to make said first number equal to said third number while reducing said second number by the value of said fourth number for subsequent calculation purposes;

said microprocessor executing said program means for implementing said second sequence of program steps to generate a first motor speed control signal using said first stored number and said set of second stored values, for generating a second speed control signal whenever the difference between said first and second values for a particular number of operating strands being wound exceeds a first predetermined value and for generating a second STOP signal whenever the difference between said first and second stored values for a particular number of operating strands being wound exceeds a second predetermined value, said motor speed control means being responsive to said first motor speed control signal for initially operating said winder motor at a predetermined initial control speed depending upon said number of operating strands being wound, being responsive to said second motor speed control signal for selectively increasing and decreasing the winding speed of said motor to avoid strand breakage while maintaining package uniformity and the like, and being responsive to either of said first and second STOP signals for turning off said winding motor to shut down said roving process.

31. A method of controlling the speed of a plurality of strands being moved along a path and being formed into a product, said method comprising the steps of: advancing the strands along said path; storing a plurality of desired speeds, each of which corresponds to a different product to be formed by the process; selecting a particular speed based upon the particular product being formed; measuring the actual speed; comparing the actual speed to the desired speed; increasing and decreasing the speed when the difference between the actual speed and the desired speed exceeds a predetermined amount; sensing the number of strands actually being moved in the process; comparing the sensed number of strands with a desired number of strands required for forming said particular product; indicating whether a prepared standby strand must be added to the number of strands actually being moved to provide the desired number of strands; and inserting said standby strand as required.

32. A method for processing a plurality of strands to form a product comprising the steps of:

providing a first indication representing a desired number of strands required to form a particular product;

providing a second indication representing a standby number of strands prepared for insertion into the particular product being formed;

sensing the number of strands actually being used to form the product and detecting when said actual number of strands is less than said desired number and providing a third indication thereof; and inserting at least one of the said standby strands into the product being formed responsive to said third indication.

33. The method of claim 32 further including the step of stopping the process when said first indication exceeds said third indication and there are no standby bundles for insertion.

34. Apparatus for processing a plurality of strands to form a product:

means for indicating the strands required for said product;

means for sensing the strands being processed;

means for monitoring the standby strands ready for insertion into said plurality of strands; and strand insertion means for inserting said standby strands into said plurality of strands, comparison means for comparing said required strands with said sensed strands, said strand insertion means inserting one of said standby strands into said strands being processed until the sensed strands being processed equal said required strands for a particular product.

35. The apparatus of claim 34 further comprising a process shut-down means responsive to a lack of standby strands in response to an output from the strand insertion means, to stop said process.

36. Apparatus for controlling the speed of a plurality of strands being moved along a path and being formed into a product comprising:

means for storing a plurality of desired speeds for moving separate products along said path;

means for selecting a particular one of said plurality of stored speeds for a respective product;

means for measuring the actual speed of movement of said strands;

means for increasing and decreasing the speed of said movement of said strands, when the defference between said measured actual speed and said selected stored speed exceeds a first predetermined value;

means for indicating the strands required for said product;

means for sensing the strands being processed;

means for monitoring the standby strands ready for insertion into said plurality of strands; and strand insertion means for inserting said standby strands into said plurality of strands, comparison means for comparing said required strands with said sensed strands, said strand insertion means inserting one of said standby strands into said strands being processed until the sensed strands being processed equal said required strands for a particular product.

37. The apparatus of claim 36 further comprising means for stopping said movement when the difference between said measured actual speed and said selected speed exceeds a second predetermined value.

38. The apparatus of claim 36 further comprising binary coded decimal switches for manually entering said desired motor speed functions into said storage means.

* * * * *